US010155235B2

(12) United States Patent
Matlack

(10) Patent No.: US 10,155,235 B2
(45) Date of Patent: Dec. 18, 2018

(54) SYSTEM AND METHOD FOR FILLING TANKS ON A CUSTOMIZED PAINT VEHICLE

(71) Applicant: Michael Matlack, Winter Park, FL (US)

(72) Inventor: Michael Matlack, Winter Park, FL (US)

( * ) Notice: Subject to any disclaimer, the term of this patent is extended or adjusted under 35 U.S.C. 154(b) by 69 days.

(21) Appl. No.: 15/134,874

(22) Filed: Apr. 21, 2016

(65) Prior Publication Data

US 2016/0310986 A1 Oct. 27, 2016

Related U.S. Application Data

(60) Provisional application No. 62/150,359, filed on Apr. 21, 2015.

(51) Int. Cl.

| | |
|---|---|
| ***B05B 5/08*** | (2006.01) |
| ***E01C 23/00*** | (2006.01) |
| *B05B 12/14* | (2006.01) |

(52) U.S. Cl.

CPC ..... *B05B 5/085* (2013.01); *E01C 23/00* (2013.01); *B05B 12/1463* (2013.01)

(58) Field of Classification Search

CPC ..... B05B 5/085

See application file for complete search history.

(56) References Cited

U.S. PATENT DOCUMENTS

| | | | | |
|---|---|---|---|---|
| 3,904,117 | A * | 9/1975 | Adams, Jr. | A62C 27/00 239/146 |
| 3,976,227 | A * | 8/1976 | Ray | B01J 4/02 137/575 |
| 4,133,340 | A | 1/1979 | Ballard | |
| 4,785,836 | A | 11/1988 | Yamamoto | |
| 4,830,882 | A | 5/1989 | Ichinose et al. | |
| 5,174,317 | A | 12/1992 | Robb et al. | |
| 5,522,439 | A * | 6/1996 | Hakansson | B65B 3/30 141/177 |
| 7,691,800 | B2 | 4/2010 | Weiss | |
| 2003/0111129 | A1 * | 6/2003 | Mills, Jr. | B67D 7/02 141/1 |
| 2004/0175278 | A1 | 9/2004 | Dexter et al. | |
| 2006/0144961 | A1 | 7/2006 | Dekeyser et al. | |
| 2007/0045289 | A1 | 3/2007 | Kott et al. | |
| 2007/0186961 | A1 | 8/2007 | Seasly et al. | |
| 2015/0097051 | A1 | 4/2015 | Jessup et al. | |

* cited by examiner

*Primary Examiner* — Michael P. Rodriguez
(74) *Attorney, Agent, or Firm* — Ferdinand M. Romano

(57) ABSTRACT

A method for filling a tank with a coating material on a vehicle. The method includes providing containers of coating material to a location of the vehicle and inserting a draw tube into one of the containers. The method also includes pumping coating material using a draw pump and into the tank on the vehicle. The method also includes removing residual coating material from the containers and adding the residual coating material to the tank. If the coating material level is not at a desired level, the inserting, pumping, removing, and adding steps are repeated with another container of coating material. If the coating material level is at the desired level, a layer of water may be formed over coating material in the tank.

10 Claims, 21 Drawing Sheets

SYSTEM AND METHOD FOR FILLING TANKS ON A CUSTOMIZED PAINT VEHICLE

CROSS REFERENCE TO RELATED APPLICATIONS

This application claims the benefit of U.S. Provisional Application Ser. No. 62/150,359 filed Apr. 21, 2015 and incorporated herein by reference in its entirety.

FIELD OF THE INVENTION

The invention relates to industrial systems and methods for applying coating materials and, more particularly, to mobile systems and methods for providing and dispensing liquid coating materials for application to surfaces.

BACKGROUND

Conventional vehicles are used to transport paint to a job site in connection with a painting project. One or more buckets of paint are transported in the conventional vehicle to the job site, after which the buckets of paint are carried from the vehicle to one or more locations around the job site. A sprayer or brush is then used to apply paint from the one or more buckets to a surface at each of the one or more locations around the job site.

SUMMARY OF THE INVENTION

According to an embodiment of the invention a method for providing liquid coating material for application to surfaces, includes providing a mobile road vehicle having a bed on which a plurality of tanks are mounted for use on the vehicle. The combined holding capacity of the tanks may be at least 300 gallons. The vehicle further includes a plurality of hydraulic sprayers mounted for powered operation on the vehicle and a plurality of feed lines connected to extend from the mounted sprayers to dispense coating material at least 200 feet away from the vehicle. The vehicle is placed at a location at which a supply of the coating material is present for transfer into the tanks. A pumping system is provided to transfer coating material from the supply to the tanks. The pumping system includes one or more draw tubes. A manifold, connected between the pumping system and the tanks, includes multiple fill lines, each extending to one of the tanks. A fill valve is positioned in each fill line for (i) control of flow of coating material into at least one of the tanks and (ii) selection of a tank for receipt of the coating material. The control and selection enable transfer of different coating materials into different tanks via the one or more draw tubes. The coating material is pumped from the supply at a minimum rate of two gallons per minute into the one or more tanks via the manifold.

The supply may be in the form of multiple containers each having a nominal holding capacity of at least five gallons of coating material, the totality of containers providing enough coating material to fill at least one tank. The step of pumping the coating material may include using the pumping system to transfer the coating material from the totality of containers, through the one or more draw tubes and into one or more tanks on the vehicle.

There is disclosed a system of providing liquid coating material, including paint, for application to surfaces with a coating delivery. The system includes a mobile road vehicle and a plurality of tanks mounted for use on the vehicle, where the combined holding capacity of the tanks is at least 300 gallons. The system also includes a plurality of hydraulic coating material sprayers mounted for powered operation on the vehicle. The system also includes a plurality of feed lines connected to extend from the mounted sprayers to dispense a coating material at least 300 feet away from the vehicle. The system also includes a pumping system to transfer coating material from a supply to one or more tanks, where the pumping system includes one or more draw tubes. The system also includes a manifold connected between the pumping system and the tanks, the manifold including multiple fill lines, each extending to one of the tanks. The system also includes a sensor to measure the level of coating material within each tank, where the sensor is configured to transmit a signal to the pumping system when the level of coating material in the one or more tanks is at the desired level to deactivate the pumping system.

A method is also provided for dispensing liquid coating material for application to surfaces. In one embodiment the method includes providing a mobile road vehicle having a bed on which a plurality of tanks are mounted for use on the vehicle, with the combined holding capacity of the tanks being at least 300 gallons. The tanks are filled with coating material to a predetermined level. The vehicle further includes a plurality of hydraulic sprayers mounted for powered operation on the vehicle and a plurality of hose lines connected to extend from the mounted sprayers to dispense the coating material at least 200 feet away from the vehicle. A first input manifold is connected between multiple ones of the tanks and at least a first of the hydraulic sprayers, the first input manifold including a plurality of manifold input lines, each connected to receive flow of coating material from one of the tanks. The manifold also includes at least one output line connected between the manifold input lines and at least one of the hydraulic sprayers to carry flow of coating material from the manifold input lines to at least one of the hydraulic sprayers. The method may include providing one or more additional input manifolds, with each input manifold including a plurality of additional manifold input lines and at least one output line. Each additional input manifold is also connected to receive flow of coating material from one of the tanks, and the at least one output line is connected between the manifold input lines and at least one of the hydraulic sprayers to carry flow of coating material from the manifold input lines to at least one of the hydraulic sprayers. The method may also include providing one or more valves to control flow from one or more input lines in the first input manifold to enable selection of flow of coating material into the at least one of the hydraulic sprayers. Valves may selectively deliver the coating material between different hose lines.

There is disclosed a system of dispensing liquid coating material, including paint, to surfaces at a job site. The system includes a mobile road vehicle and a plurality of tanks mounted for use on the vehicle. The combined holding capacity of the tanks is at least 300 gallons. Each tank includes an output valve. The system further includes a plurality of hose reels on the vehicle, each hose reel including an input valve. The system further includes a hydraulic sprayer mounted for powered operation on the vehicle with an input manifold connected to the plurality of tanks and an output connected to the plurality of hose reels. The hydraulic sprayer is configured to draw coating material through the intake manifold from at least one of the plurality tanks based on the output valve of the at least one tank in an open position. The coating material sprayer is configured to deliver coating material from the output to at least one of the plurality of hose reels based on the input valve of the at least one hose reel in an open position.

There is disclosed a method for cleaning liquid coating material from one or more tanks on a vehicle. The method includes opening an output valve of the one or more tanks on the vehicle. The method further includes draining coating material of a first type through the output valve of the one or more tanks. The method further includes applying pressurized water along an inside surface of the one or more tanks to remove residual coating material of the first type from the inside surface of the one or more tanks. The method further includes draining the water through the output valve of the one or more tanks and repeating the applying and draining steps if the drained water includes the residual coating material of the first type.

There is disclosed a method for cleaning liquid coating material from one or more tanks on a vehicle. The method includes opening a first output valve of one or more tanks on a vehicle. The method further includes draining coating material of a first type through the first output valve of the one or more tanks and drawing pressurized water from a pump on the vehicle through a water intake valve of the one or more tanks. The method further includes applying the pressurized water along an inside surface of the one or more tanks to remove residual coating material of the first type from the inside surface of the at least one tank. The method further includes draining the water through a second output valve of the one or more tanks. The method further includes spraying the water through one or more hoses connected to the second output valve. The method further includes repeating the drawing, applying, draining and spraying steps if the sprayed water through the one or more hoses includes residual coating material of the first type. The method further includes pumping coating material of a second type through a fill valve of the one or more tanks using a draw pump if the sprayed water through the one or more hoses excludes residual coating material of the first type.

There is disclosed a system for cleaning liquid coating material from one or more tanks on a vehicle. The system includes a vehicle and a plurality of tanks on the vehicle. The system also includes a container to drain coating material of a first type from one or more tanks. The system also includes a water delivery device within each tank and a pump on the vehicle configured to provide pressurized water to the water delivery device within the one or more tanks to apply the pressurized water along an inside surface of the one or more tanks to remove residual coating material of the first type from the inside surface. The system also includes one or more hoses configured to spray the water from the one or more tanks.

There is disclosed a method for cleaning a nozzle of a spray gun. The method includes drawing pressurized water from a pressure washer to an open container. The method further includes ejecting the pressurized water within an interior of the open container. The method further includes inserting the spray gun nozzle into the interior of the open container to impact the spray gun nozzle with the ejected pressurized water for a minimum time period. The method further includes draining water from the open container.

There is disclosed a method for cleaning a nozzle of a spray gun. The method includes spraying coating material from a spray gun nozzle on an end of a hose. The method further includes drawing pressurized water from a pressure washer to an open canister and ejecting the pressurized water from orifices within an interior of the open canister. The method further includes inserting the spray gun nozzle into the interior of the open canister for a minimum time period. The method further includes rotating the spray gun nozzle within the interior of the open canister to direct the pressurized water on the spray gun nozzle from multiple angles to dislodge residual coating material accumulated on the spray gun nozzle during the spraying step. The method further includes draining water from the open canister.

There is disclosed a system for cleaning a nozzle of a spray gun. The system includes a vehicle including the spray gun nozzle to perform a project at a job site. The system further includes a pressure washer on the vehicle to draw water from a first holding tank on the vehicle. The system further includes a pressure washer valve between the pressure washer and the component such that the pressure washer is configured to deliver pressurized water to the spray gun nozzle to clean the spray gun nozzle when the pressure washer valve is in an open position. The system further includes a second holding tank on the vehicle other than the first holding tank and configured to receive the pressurized water used to clean the component.

BRIEF DESCRIPTION OF THE DRAWINGS

Embodiments are illustrated by way of example, and not by way of limitation, in the figures of the accompanying drawings in which like reference numerals refer to similar elements and in which.

DETAILED DESCRIPTION

Figure 1:
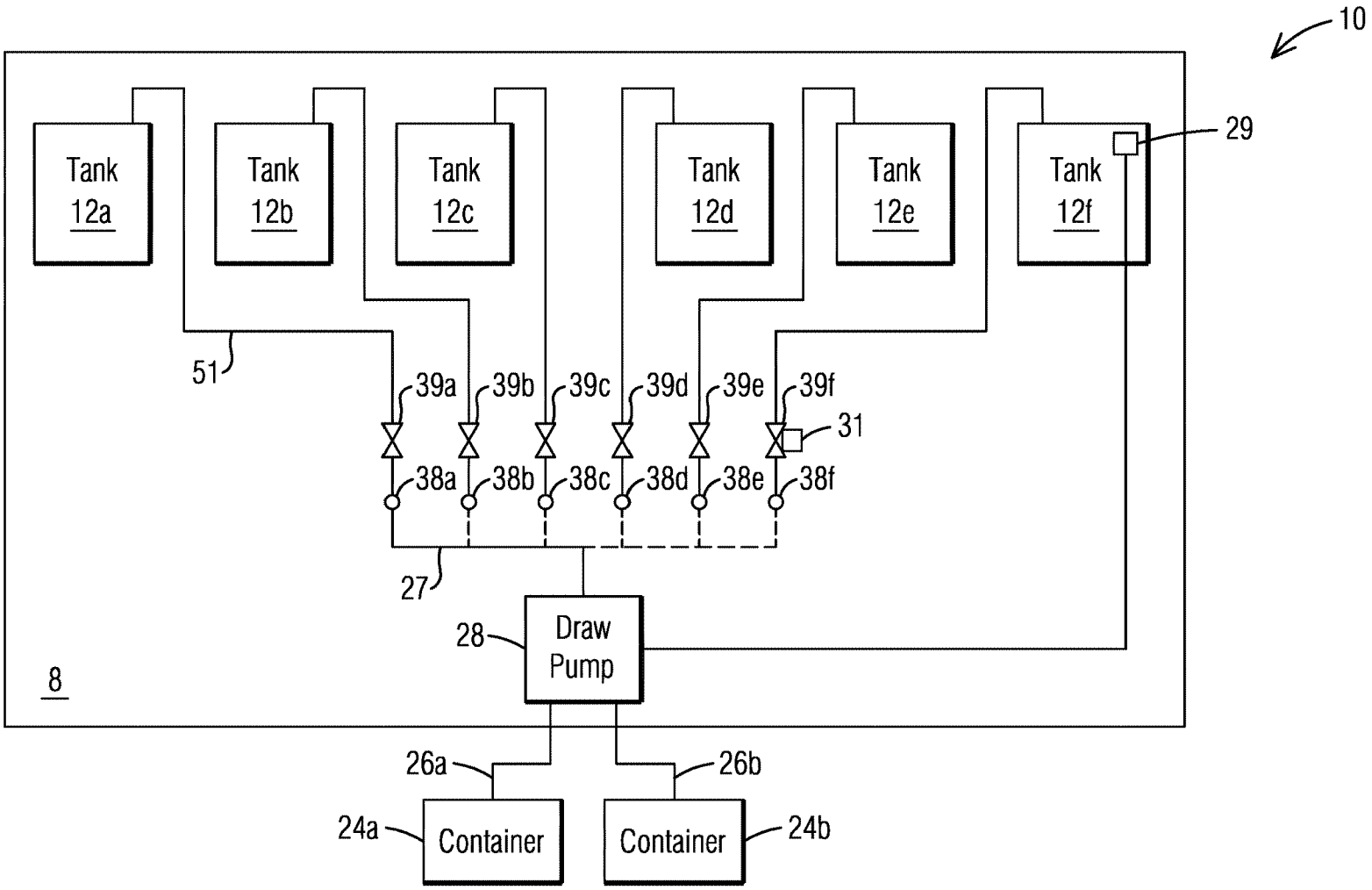
FIG. 1 is a block diagram of a system for filling tanks on a vehicle with liquid coating material, according to an embodiment.

A mobile industrial painting system 4 is described. The terms paint and coating material are used interchangeably to describe the invention, meaning a wide variety of spray-on coatings, including paints, primers, sealants and a variety of finish coatings typically applied to surfaces.

The example system comprises a series of subsystems assembled on a vehicle 8, e.g., a customized truck, required to perform daily activities for large scale industrial painting of buildings and other structures. The subsystems include: a paint filling system 10 which transfers large quantities of paint onto the vehicle for high volume dispensing; a multi-user paint dispensing system 200 which pumps the paint from large reservoir tanks through multiple hose lines that enable simultaneous spraying of different coatings, and up to three colors, by operators at large distances from the vehicle (e.g., interior and exterior work in different buildings or in different rooms of the same building); and a series of cleaning and maintenance systems which reduce cleaning time and extend equipment life, including; a nozzle spray cleaning system 600; a tank cleaning system 400 which facilitates changing of coating types and colors in the reservoir tanks; a pump lubrication system 1000; and a multi-pump oil changing system 800 for motorized equipment installed on the vehicle 8. Generally, the mobile industrial painting system 4 provides a series of features which reduce equipment operating costs and reduce the time and costs for preparing and performing painting services. The unique combination of subsystems provide overall reductions in labor required for performing daily activities (e.g., set-up, actual painting, cleaning and associated maintenance), permitting division of labor, a higher level of productivity and lower overall cost of providing services.

Before describing the subsystems in detail, exemplary features of a few of the subsystems are summarized. The tank filling system 10 provides high volume delivery of paint into a series of tanks during a large volume dedicated fill operation that can transfer the liquid from over a hundred smaller (e.g., five gallon capacity) containers. The process avoids loss due to non-transfer of residual paint. The process prevents loss of liquid which normally remains in a container with a conventional paint pumping system that draws paint directly from the smaller container because the conventional systems do not draw all of the paint from the smaller containers. However, during a transfer operation with the filling system 10 the system can minimize the amount of residual paint in the container and the operator can manually facilitate transfer of any paint remaining in the container after a pumping system initially transfers most of the contents. Thus the system 10 enables a practical method for preventing loss of relatively small amounts of paint, e.g., between two and eight ounces, which would otherwise be cumulatively lost in the process of serially drawing paint from multiple small containers.

The tank dispensing system 200 provides a level of flexibility heretofore not available to customize operations for the needs of a particular activity. For example, with multiple tanks, each connected to operate through a dedicated pump system, the mobile system can carry a different coating material (e.g., interior or exterior paint or primer) in each tank and the associated pump system can feed multiple spray lines so that multiple painters can each quickly change the coating being dispensed without having, for example, to clear the pumps, intake lines, hoses and spray equipment when changing the coating. This avoids waste and eliminates a series of steps normally taken by a painter in order to transition between coating applications or to move between rooms in a building that have different requirements. Advantageously, multiple long hoses (e.g., greater than two hundred feet in length, and ranging up to 400 feet or more), connected to each of the tanks, spray hoses can easily deliver paint to various locations around a job site, instead of having to bring heavy, cumbersome buckets of paint into, or within a few feet of, a room being painted so the workers can paint using spray guns on the end of the hoses. Another advantage of the tank dispensing system 200 is that the tanks on the vehicle 8 are sufficiently large that multiple workers can continuously draw paint for large surface areas without frequent disruptions to refill paint containers. Instead, painters spend a higher percentage of time painting instead of changing paint containers and cleaning work areas after changing containers. Further, when changing the type of coating to be applied (e.g. when going from a primer to a paint, it is no longer necessary to clear the lines feeding the sprayer since lines for each coating type or color can be dedicated. The painter can simply disconnect the sprayer, clean the sprayer with the system 600 and attach the sprayer to a different feed line to provide the next coating.

With the tank dispensing system 200 providing an ability to rapidly change the coating being sprayed, it becomes advantageous to move the sprayers among feed lines containing different coatings. The nozzle cleaning system 600 is readily and conveniently available [in a work station format] for rapid light cleaning when changing the coating and for deep cleaning, such as required after extended use or drying of coating material, to remove residual paint which typically builds up inside a nozzle or a safety housing or along the tip of the spray gun. Advantageously, the system allows a person to clean the spray gun nozzles by selectively applying high pressure water to impinge on surfaces of the nozzles and dislodge residual paint, e.g., on the inside of the nozzle.

In the past it was not practical to use large, e.g., 50 to 100 gallon capacity, tanks to dispense paint, in part because storage of paint for long periods of time in vessels exposed to air causes drying and collection of residues which would have to be completely removed from the vessel interior before introducing a different type or a different color of coating material. The tank cleaning system 400 is provided on the vehicle 8 for in situ cleaning, whenever it becomes necessary, to replace a first type of coating used in one of the tanks with a second type of coating. The system 400 quickly cleans interior surfaces of the tank to ensure that the first type of coating has been completely rinsed from the tank before the second type of coating is added to the tank.

The mobile industrial painting system 4 comprises dedicated equipment, e.g., pumps, compressors or generators, which are non-portable. Rather the equipment is mounted for efficient use within the mobile unit. Accordingly, the system 4 comprises subsystems which facilitate routine care and maintenance without having to be moved from positions of operation. For example, systems are also provided on the vehicle 8, to service hydraulic paint sprayers used in conjunction with the tank dispensing system 200. Also, an in situ oil changing system 800 enables convenient changing of engine oil in hydraulic sprayers, with an auxiliary reservoir system 100 provided to refill oil reservoirs in the machinery and to collect spent oil.

Figure 4:
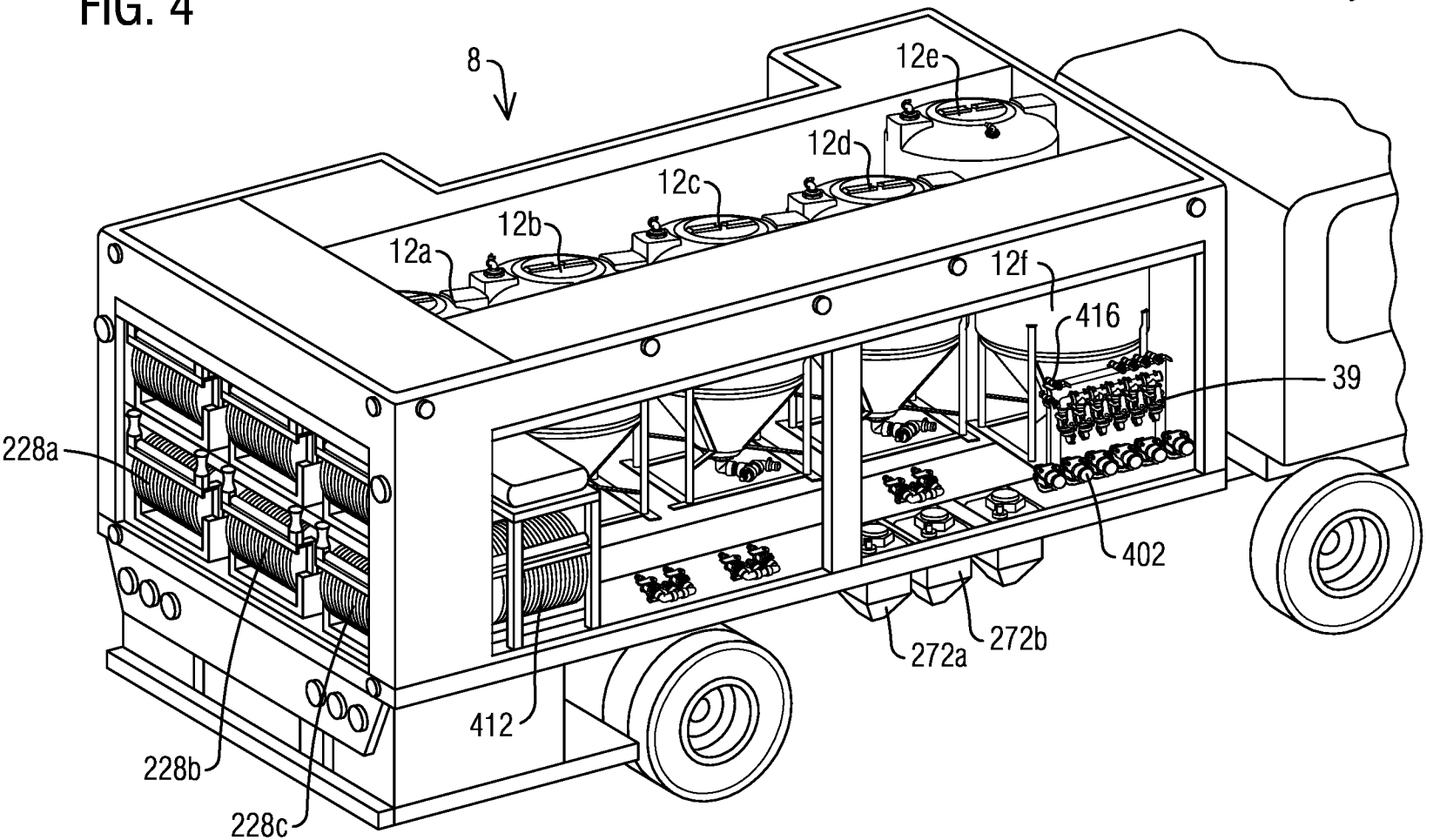
FIG. 4 is a side perspective view that illustrates an example of the system of FIG. 1, according to an embodiment.

FIG. 1 schematically illustrates a system 10 for dispensing paint into a series of tanks 12*a-f* on a vehicle 8, for high volume delivery during a painting operation involving multiple paint sprayers. As shown in FIG. 4, six tanks 12*a*-12*f* are positioned on the bed of a vehicle 8 (e.g., a truck). Each tank 12 has an 85 gallon capacity. The combined volume of the tanks 12 provides sufficient volume for a full work day of painting while also affording flexibility to provide different kinds of paint and primers as well as paint of varied colors during the work day without having to refill the system. However, the tanks 12 are not limited to any particular tank size and the paint dispensing system 200 is not limited to any particular number of tanks mounted on the vehicle 8. The tank filling system 10 advantageously fills one or more of the tanks 12 with paint, prior to commencement of the painting project (e.g. at a job site or at a facility having the paint supply). The paint supply may, for example, be available in relatively small (e.g., five gallon size) containers or in large containers (sometimes referred to as totes) holding up to or over 250 gallons of material.

FIG. 1 depicts the tank filling system 10, for performing a first phase of filling one or more of the tanks 12 mounted on the vehicle 8. In this example, multiple containers 24, such as multiple standard capacity (e.g., five-gallon) buckets of paint are provided in sufficient quantity to provide the vehicle with a sufficient volume of paint to fill the tanks as required for a job. For example, if a project requires 300 gallons of coating material, then the contents of 60 standard capacity (e.g. five-gallon) containers 24 of material would be transferred into the tanks. The tank filling system 10 includes a siphon or draw tube 26 with a first end that is inserted into each five-gallon container 24 of paint. To minimize exposure of paint in the bucket to the air, the first end of the draw tube 26 is inserted through a conventional, relatively small cap opening in the lid of the container 24. A second end of the draw tube 26 is connected to an input of a draw pump 28. Multiple draw tubes 26*a* and 26*b*, may be simultaneously inserted into multiple containers 24*a* and 24*b* and simultaneously connected to one or more draw pumps 28. Although FIG. 1 depicts two draw tubes 26*a* and 26*b* simultaneously inserted into two containers 24*a* and 24*b* and simultaneously connected to the draw pump 28, more than two draw tubes 26 can be simultaneously inserted into more than two respective containers and simultaneously connected to the draw pump 28. In another example embodiment, each of the multiple draw tubes 26*a* and 26*b* can be connected to a different draw pump 28. As shown in FIG. 1, the draw pump 28 includes an output manifold with manifold lines 38*a*-38*f* leading to the tanks 12, with a series of fill valves 39*a*-39*f* each positioned in a manifold line to control flow to one of the respective tanks 12*a*-12*f*. An output hose 51 connects each fill valve 39 to an opening in a top of each tank 12. One or more fill valves are opened, depending on which of the tanks 12 are to be filled with paint from the containers 24. Multiple tanks can be simultaneously filled with paint, if it is desired to fill the multiple tanks with the same type of paint in the containers 24. As an example, if paint of a first color from containers 24 is to be filled in tanks 12*a* and 12*b* only, only fill valves 39*a* and 39*b* are opened during the filling of the first color paint from containers 24. Similarly, if paint of a second color from containers 24 is to be filled in tanks 12*c* and 12*d*, only fill valves 39*c* and 39*d* are opened during the filling of the second color paint from containers 24. When paint of the first color from containers 24 is to be filled in tank 12*a*, only the fill valve 39*a* is opened. The fill valve 39*b* is kept closed until the first color paint is filled in tank 12*a*, after which the fill valve 39*b* is opened and fill valve 39*a* is closed until the first color paint is filled in tank 12*b*. The fill valves are provided with tags 31 (FIG. 1) to identify a paint type or color for feeding each tank 12 as shown for one of the tanks in FIG. 1. For example, the tag 31 may associate a green paint color with a particular one of the tanks 12. Upon activating the draw pump 28, paint from the containers 24*a* and 24*b* is siphoned or pumped through draw tubes 26*a* and 26*b*, transferred through the open fill valves 39 and into those tanks 12 corresponding to the open fill valves.

Figure 2:
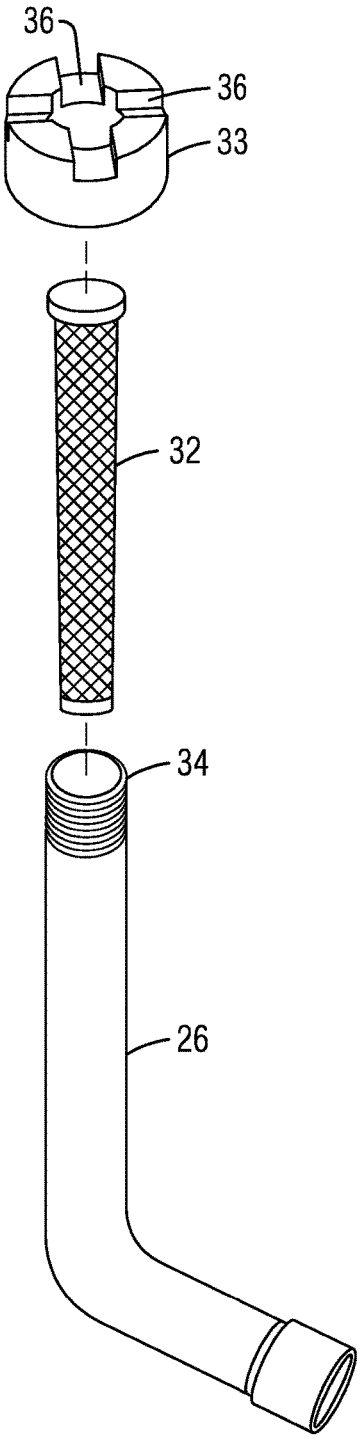
FIG. 2 is an exploded view that illustrates an example of a cap with grooves to secure a filter within a draw tube of the system of FIG. 1, according to an embodiment.

FIG. 2 is an exploded view that illustrates an example of a cap 33 with grooves 36 that is used to secure a filter 32 within the draw tube 26 of the system 10 of FIG. 1, according to an embodiment. The filter 32 is inserted in a first end 34 of the draw tube 26, and the cap 33 is then threaded onto the first end 34. The filter 32 is used to strain paint as it is drawn out of the paint container 24, i.e., to remove any unwanted contaminants or other material from the paint. The first end 34 of the draw tube 26 is positioned in the container 24 and the cap 33 is in contact with a base of the container 24. The grooves 36 prevent square contact of the cap 33 with the base of the container 24, which would lead to unwanted suction on the base of the container 24. In an example embodiment, the grooves 36 are orthogonal to one another and form a cross about the draw tube opening.

After the paint has been drawn from each container 24 into one or more tanks 12, to avoid waste, residual paint in the container 24 may be manually removed by scraping the interior of the container 24. An instrument such as a spatula is used to remove the residual paint from the bucket 24. The residual paint is then added to the one or more tanks, after consolidating the residual paint into one or more containers 24 and pumping the residual paint from the one or more containers 24 into the tanks using the draw tube 26 and draw pump 28. Providing added improvement in cost efficiency, approximately 4 gallons of residual paint are recoverable for addition to the tanks 12 for every 100 gallons of paint that are drawn into the tanks 12. In an example embodiment, the recovery rate of the residual paint is in a range is 3 to 5 percent. This includes heavy paint which sticks to the sides of the 5 gallon containers. In one example embodiment, the residual paint is manually collected from the containers 24 (e.g. 5 gallon) and consolidated into one or more containers from which the residual coating material is transferred to one or more of the tanks with the pumping system (i.e. the draw tube 26 and draw pump 28). Additionally, this example embodiment provides an advantage of labor saving efficiency since one worker can operate the system 10 and draw paint from the containers 24*a* and 24*b* into the one or more tanks 12 while another worker simultaneously removes residual paint from another container 24 and adds the residual paint to the one or more tanks 12.

After paint is drawn from each container 24 into the one or more tanks 12, if the level of paint in the one or more tanks 12 is not at the desired level, with the first ends 34 of one or more of the draw tubes 26*a* and 26*b* inserted into another of the containers 24*a* and 24*b*, the draw pump 28 is activated to draw paint from one or more full containers 24*a* and 24*b* into the one or more tanks 12. If the level of paint is at the desired level, the first phase of the filling of the tanks 12 is complete. The level of paint in the one or more tanks 12 may be visually monitored by a worker and the draw pump 28 may be manually shut off by the worker when the level of paint in the one or more tanks 12 reaches the desired level. In another embodiment, a sensor 29 (see FIG. 1) is provided in each of the tanks 12 to monitor change in the level of paint within the tanks 12. Although FIG. 1 only depicts the sensor 29 in the tank 12*f*, it is to be understood that sensors 29 may be provided in each of the tanks 12*a*-12*f*. Signals from the sensors 29 are provided to deactivate the draw pump 28 when the level of paint in the one or more tanks 12 reaches the desired level. For example, the desired level may be reached in an 85 gallon tank 12 when the paint level reaches a level corresponding to a volume in the range of 75-85 gallons.

Figure 3:
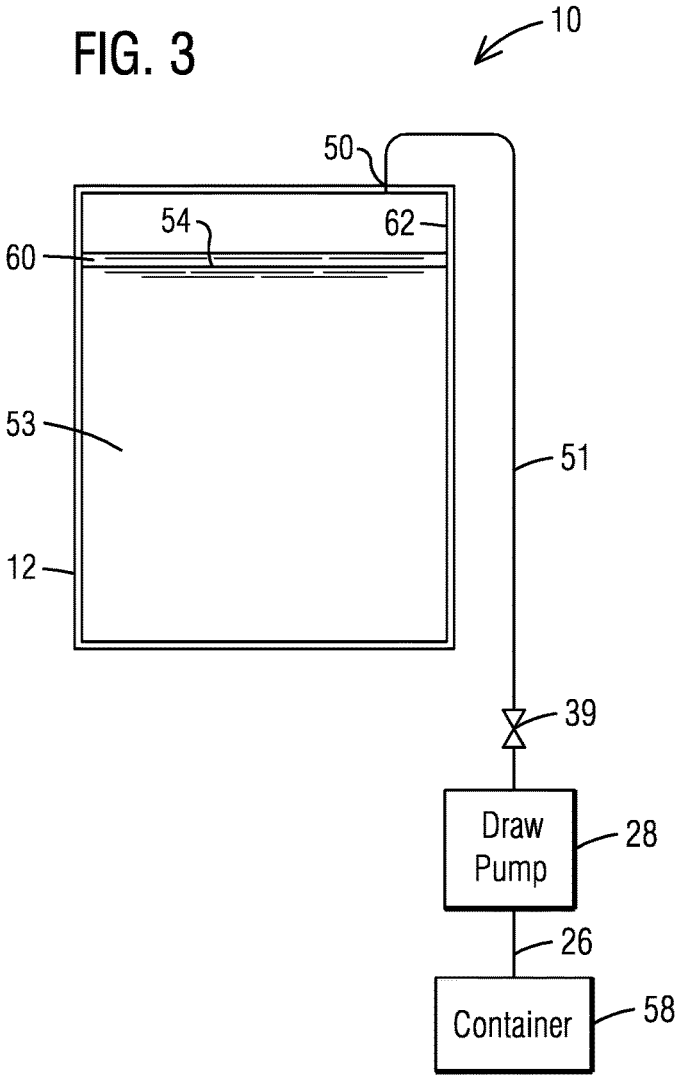
FIG. 3 is a partial view of the system presented in FIG. 1 showing components for filling an exemplary tank.

FIG. 3 illustrates a second phase of operation with the system 10 for filling a tank on the vehicle 8. Although one tank 12 is shown, all tanks 12*a*-12*f* may include this arrangement. After the paint 53 has been pumped into the tank 12 to a desired level 54, the draw tube 26 is inserted into a container of water, such as a standardized container 58 of water. The draw pump 28 is then activated to draw water from the container 58 which passes through the fill valve 39, into output hose 51 and into an opening 50 in the top of the tank 12. The water forms a layer 60 of water in the tank and on top of the paint 53. Since water has a lower density than paint, the layer 60 of water remains on top of the paint 53 within the tank 12. Placing the layer 60 of water over the paint provides several advantages. The water layer 60 and the tank 12 collectively provide a closed system for the paint 53, isolating the paint 53 from elements in the surrounding environment. This advantageously prevents a sprayer tip on a spray gun receiving paint from the tank 12 from clogging, and thus permits the worker to continuously use the spray gun for a longer time. Secondly, as the paint 53 is used and the paint level in the tank 12 diminishes, the water layer 60 on top of the paint 53 continuously washes an inside surface 62 of the tank 12 to help prevent a skin of paint from forming on the inside wall surface 62 of the tank 12 and eventually breaking away from the wall surface to be drawn into the lines leading to the paint spray guns, and possibly causing clogging in the sprayer tip. Third, if a worker neglects to check the level of the paint in the tank 12, an ejection of water from the layer 60 through the sprayer nozzle serves as an alert to refill the tank 12. This can prevent a pump that normally draws paint from the tank 12 from running dry and becoming damaged, thus avoiding major repair. This overcomes a drawback of conventional systems, where a layer of water might be placed over the surface of the coating material in a five gallon container. In these conventional systems, the draw tube is normally always kept in the same container and coating material is periodically added to the same container to replenish the container with new coating material, but with pouring of paint over the layer 60, the water layer is no longer preserved as a layer on top of the coating material and, instead, the coating material becomes diluted. Subsequently, more water would have to be added on top of the new coating material to form a new layer of water over the new coating material that was added to the container. The system 10, having the layer 60 of water on top of the coating material 53 in the tank 12 does not have the disadvantage of the conventional system, since the layer 60 of water remains on top of the coating material 53 throughout the use of the coating material in the tank 12 and thus does not dilute the coating material 53.

In an example method, with different tanks 12*a*, 12*c* in the system 10 to be filled with different colors of paint, the first colored paint is initially pumped into the first tank 12*a*. Water is then pumped into the first tank 12*a* to form a layer 60 of water floating on top of the paint 53 and then pumping continues to clear the first color paint from the pump lines (e.g., the draw tube 26). The second color paint is then pumped into the second tank 12*c*, after which a layer 60 of water is pumped into the second tank 12*c* to float on top of the paint 53 as described above. This process can be repeated for each other tank.

The filling system 10 provides numerous advantages over conventional filling systems. By filling the paint into the one or more tanks 12 prior to commencement of spray painting, there is no need for workers to carry multiple containers of paint to various locations around a job site. Instead, after the paint is transferred into the tanks 12, the paint can be delivered to each of multiple painting locations with hoses stored on reels in the vehicle 8. Each hose may extend 350 feet or farther from the tank to be dispensed, as discussed below.

Figure 5:
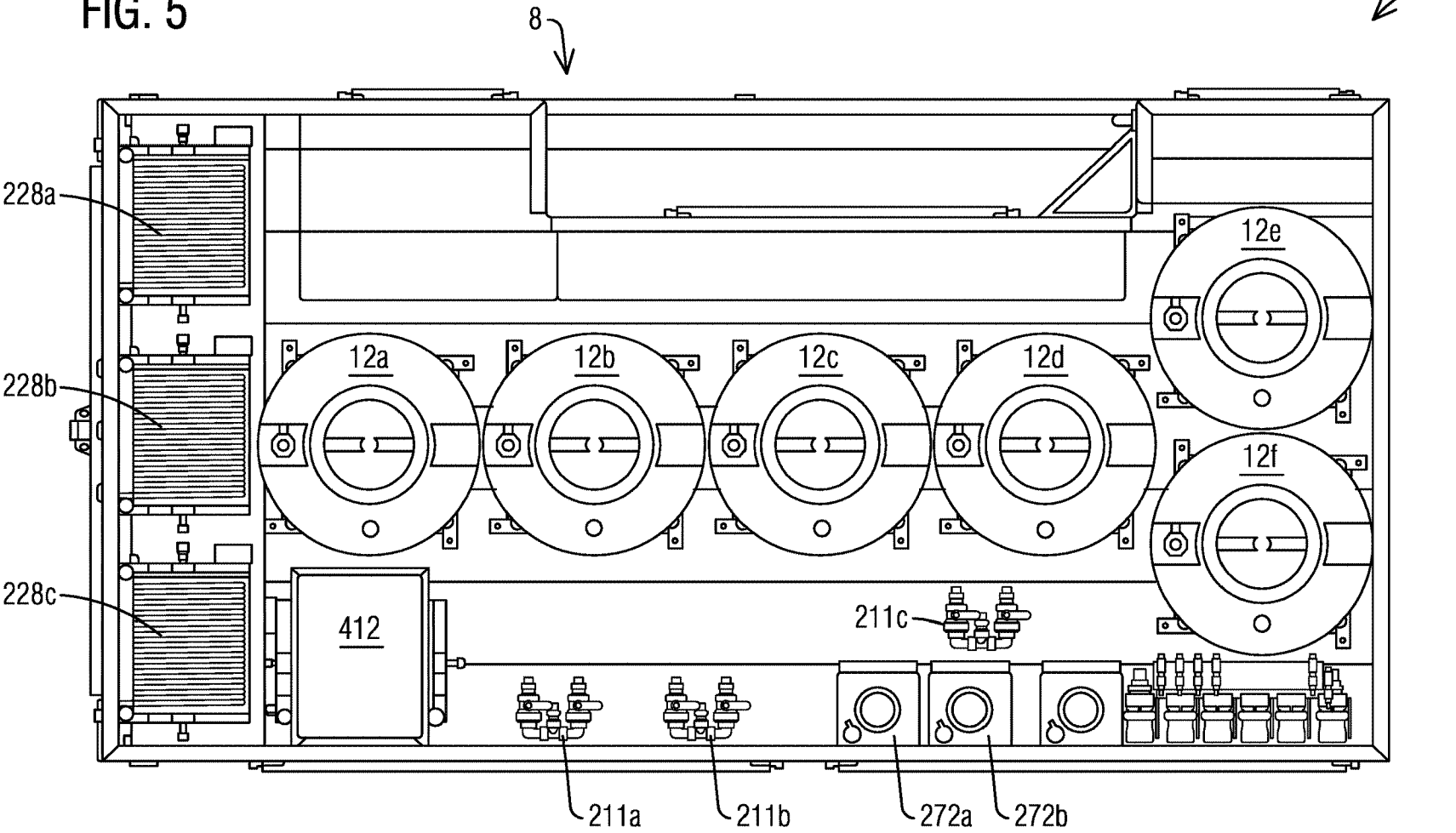
FIG. 5 is a top view that illustrates an example of the system of FIG. 4, according to an embodiment.
Figure 6B:
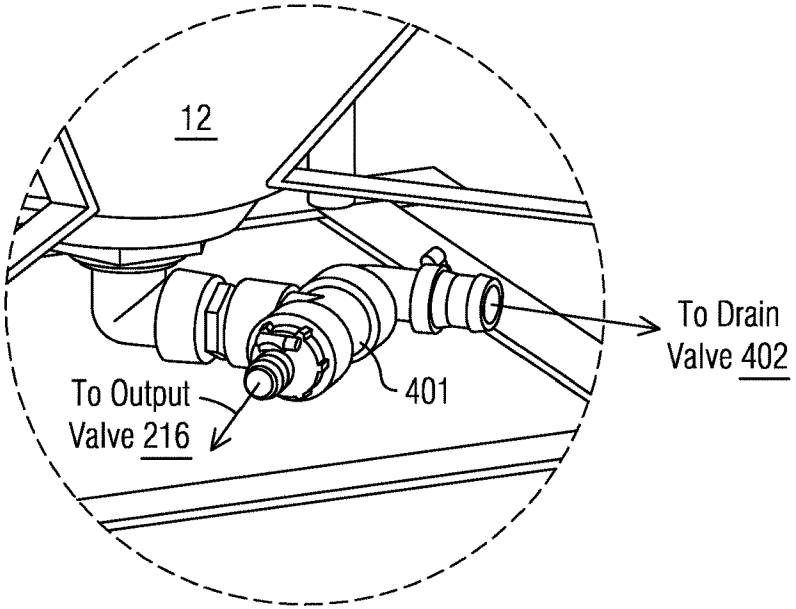
FIG. 6B is a side perspective view that illustrates an example of an output manifold of the tank of FIG. 6A, according to an embodiment.
Figure 6A:
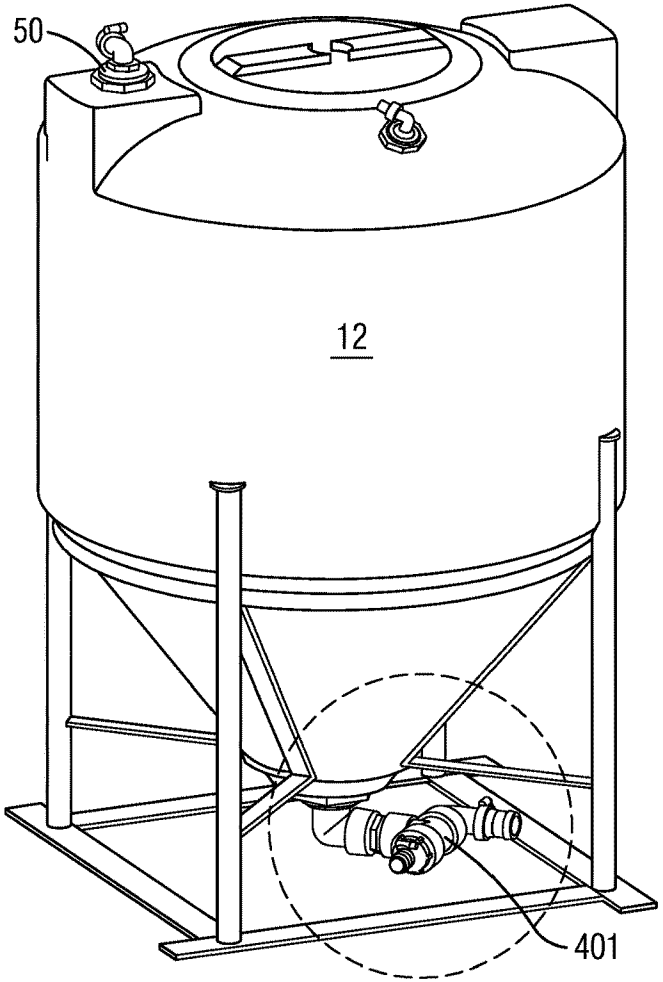
FIG. 6A is a side perspective view that illustrates an example of a tank of the system of FIG. 1, according to an embodiment.

FIGS. 4 and 5 are, respectively, side and top views of an embodiment of the system 10 installed on a vehicle 8 having six wheels. The six tanks 12*a*-12*f* are mounted on a bed of the vehicle 8. The illustrated fill valves 39 are positioned in the manifold lines 38*a*-38*f* of the draw pump 28. Although six tanks are shown on the vehicle 8, the system 10 is not limited to having any specific number of the tanks 12. FIG. 6A depicts the opening 50 in the top of the tank 12 where the output hose 51 is connected, as shown in FIGS. 1 and 3.

Figure 7:
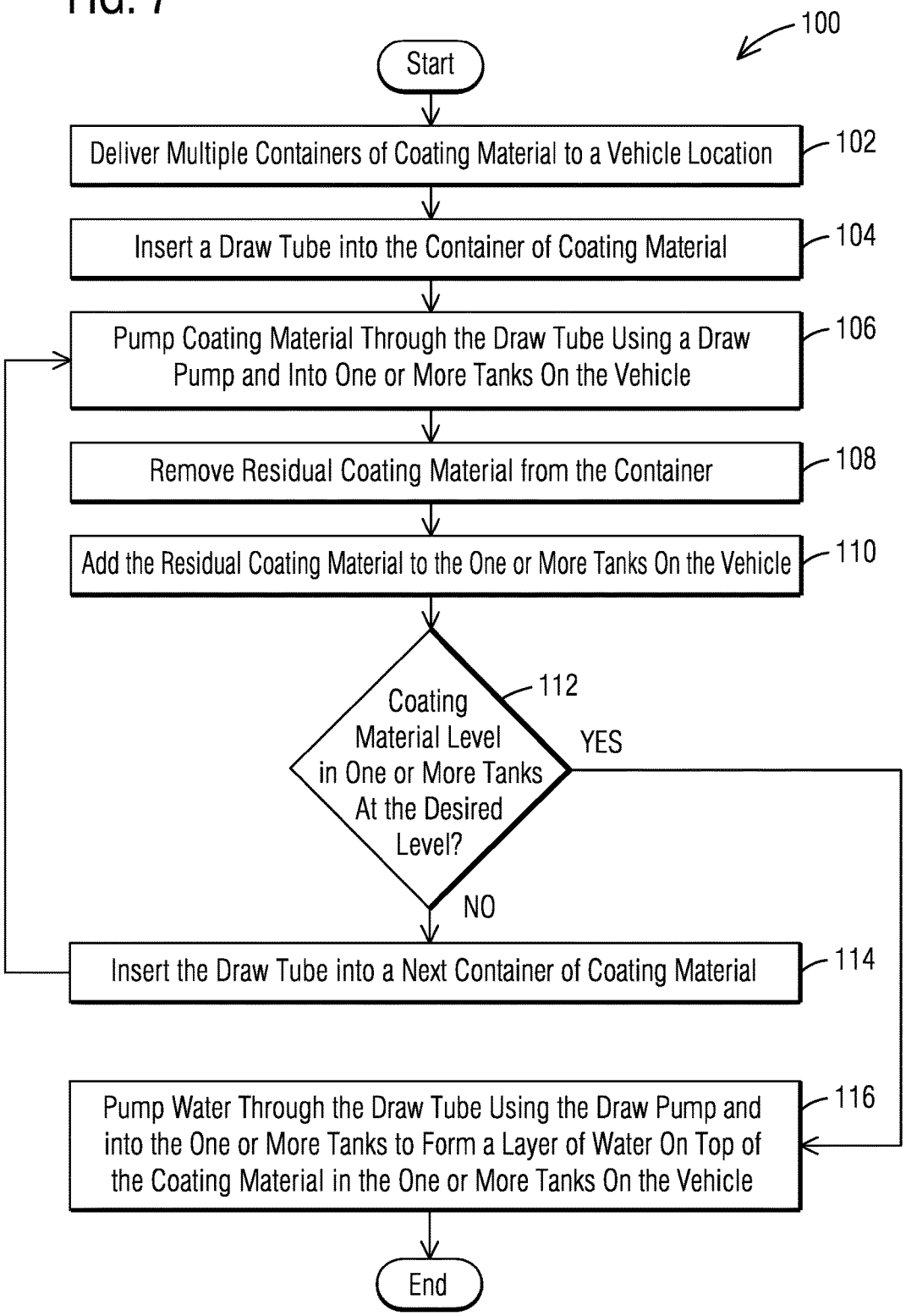
FIG. 7 is a flow diagram that illustrates an example of a method for filling tanks on a vehicle with liquid coating material, according to an embodiment.

FIG. 7 is an example flow diagram of a method 100 for filling tanks 12*a*-12*f* on the vehicle 8. In step 102, multiple containers 24 are delivered to the vehicle location. The vehicle may be located at a job site when filling the tanks or may be brought to a supply center remote from the job site, such as at the location of a paint supplier. The paint supply may, for example, be available in relatively small (e.g., five gallon size) containers or in large containers (sometimes referred to as totes) holding up to or over 250 gallons of material.

In step 104, the draw tube 26 is inserted into the container 24 of paint or into the large container (tote) of paint. Step 104 includes contacting the base of the container 24 with a spacer cap 33 on the first end 34 of the draw tube 26. Use of the cap 33 when inserting the draw tube 26 in step 104 prevents unwanted suction on the base of the container 24 because grooves 36 on the cap 33 avoid contact with the base of the container 24 that would impede flow into the draw tube 26. Multiple draw tubes, e.g., tubes 26*a* and 26*b* may be simultaneously inserted into multiple containers 24*a* and 24*b* of paint.

In step 106, paint is pumped through the draw tube 26 using the draw pump 28 and into one or more tanks 12 on the vehicle 8. In an example embodiment, step 106 includes straining the paint through the draw tube 26 to remove unwanted contaminants from the paint based on the filter 32 positioned within the draw tube 26. In an example embodiment, in step 106, paint is simultaneously pumped through the multiple draw tubes 26*a* and 26*b* that are simultaneously inserted into the multiple containers 24*a* and 24*b* in step 104 using the draw pump 28 and into one or more tanks 12 on the vehicle 8. In an example embodiment, the draw pump 28 is capable of pumping the coating material at a minimum rate of five gallons per minute. In another example embodiment, the draw pump 28 is capable of pumping the coating material from the container 24 into the manifold lines 38 at a rate of 5 gallons in 45 seconds. In an example embodiment, the pump 28 is an air-operated diaghram pump of the type driven by an air compressor. For example, the pump 28 may have a one inch diameter intake. Suitable equipment is available from Price® Pump (Sonoma Calif.). The compressor may be a model SS3 or SS5 from Ingersoll Rand (Davidson, N.C.).

In another example embodiment, step 106 includes opening one or more fill valves 39 to simultaneously pump coating material into one or more tanks 12. The fill valves 39 may be provided with paint tags 31 that identify the specified coating material by type or color of each tank 12 to contain. In the example step 106, one fill valve 39 is opened at a time to fill each tank 12 one at a time.

In step 108, residual paint is removed from the container 24. This step may include manually scraping an interior of the container 24 with an instrument, such as a spatula. The removal step 108 may be performed on a first set of pumped-out containers 24*a* and 24*b* while step 106 is simultaneously performed on a second set of containers full of coating material.

In step 110, the residual paint removed from the container 24 in step 108 is added to the one or more tanks 12. This step may include collecting residual paint from each container 24, according to step 108, into a residual container and then pumping the residual paint from the residual container using the draw tube 26 and draw pump 28.

According to step 112, a determination is made whether the level of paint in the one or more tanks 12 is at the desired, e.g., predetermined, level 54. This step 112 may be performed by visual inspection or performed with use of the sensors 29 positioned in each tank 12, the sensors each providing a signal that controls operation of the draw pump 28. Step 112 need not be performed after step 110 and step 112 may be simultaneously performed during step 106 such that the level of paint in the tanks 12 is continuously monitored during step 106 and the draw pump is deactivated during step 106 if the level of paint reaches the desired level. When step 112 indicates a positive determination, the method 100 proceeds to step 116. If step 112 results in a negative determination, the method 100 proceeds to step 114.

In step 114, the draw tube 26 is sequentially inserted into next sets of containers 24*a* and 24*b* of coating material and the method 100 proceeds to step 106. The next set of containers 24*a* and 24*b* of paint has the same type of paint as the previous set of containers 24*a* and 24*b* of paint.

In step 116, the draw tube 26 is inserted into the container 58 of water and water is pumped using the draw pump 28 from the container 58 into the one or more tanks 12 to form the layer 60 of water on top of the paint 53. For example, one to two gallons of water may be pumped into each tank 12 to form the layer 60. However, the amount of water pumped in step 116 is not limited to any specific quantity and is of sufficient quantity that the hydraulic sprayer 210 (discussed below) does not run dry prior to a discharge of water being observed through spray guns on an end of hose reels 288 connected to the hydraulic sprayer 210.

In an example, step 102 includes providing containers 24 of a first color or type coating material (first material), a second color or type coating material (second material) and a third color or type coating material (third material) at a vehicle location. Steps 104-112 provide pumping the first material type through the draw tubes 26 using the draw pump 28 and into tanks 12*a* and 12*b* until the level of the first material type in the tanks 12*a* and 12*b* is at the desired level 54. Step 116 includes pumping water through the draw tubes 26 using the draw pump 28 and into the tanks 12*a* and 12*b* to form the layer 60 of water in the tanks 12*a* and 12*b* and to clear the draw tubes 26 and the draw pump 28 of the first paint. In the example embodiment, steps 104-112 are performed to pump the second material through the draw tubes 26 using the draw pump 28 and into the tanks 12*c* and 12*d* until the level of second material type in the tanks 12*c* and 12*d* is at the desired level 54. Step 116 includes pumping water through the draw tubes 26 using the draw pump 28 and into the tanks 12*c* and 12*d* to form the layer 60 of water in the tanks 12*c* and 12*d* and to clear the draw tubes 26 and the draw pump 28 of the second material type. In the example embodiment, steps 104-112 are performed to pump the third material type through the draw tubes 26 using the draw pump 28 and into the tanks 12*e* and 12*f* until the level of third material type in the tanks 12*e* and 12*f* is at the desired level 54. In the example embodiment, step 116 includes pumping water through the draw tubes 26 using the draw pump 28 and into the tanks 12*e* and 12*f* to form the layer 60 of water in the tanks 12*e* and 12*f*. Although the example embodiment discusses pumping coating material of a first material type, a second material type and a third material type into the tanks 12*a* and 12*b*, the tanks 12*c* and 12*d*, and the tanks 12*e* and 12*f*, the example embodiment is not limited to this arrangement and includes pumping fewer or more coating materials into one or more of the tanks 12.

Figure 8:
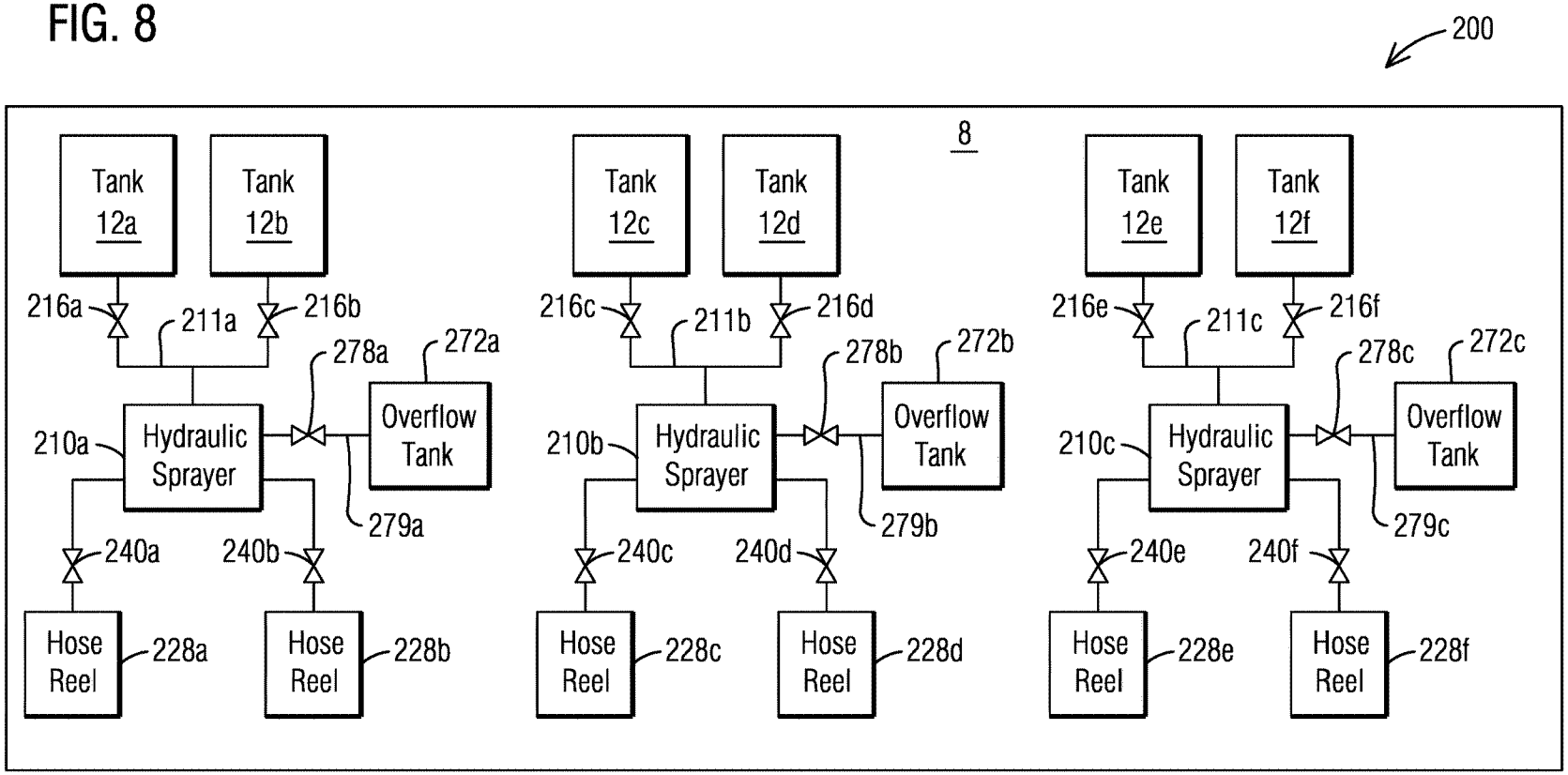
FIG. 8 is a block diagram of a system for dispensing liquid coating material from tanks on a vehicle, according to an embodiment.

FIG. 8 illustrates the system 200 for dispensing paint from tanks 12*a*-12*f* on the vehicle 8 One or more of the tanks 12 are filled with paint using the tank filling system 10 and method 100. Once the tanks 12 have been filled with coating material by the method 100, the tank dispensing system 200 is ready for workers to commence painting immediately upon arrival at a job site, without having to perform any preliminary steps, e.g., such as carrying and placing containers of paint at various locations around the job site, filling up containers of paint or moving paint sprayers around the job site.

Figure 10:
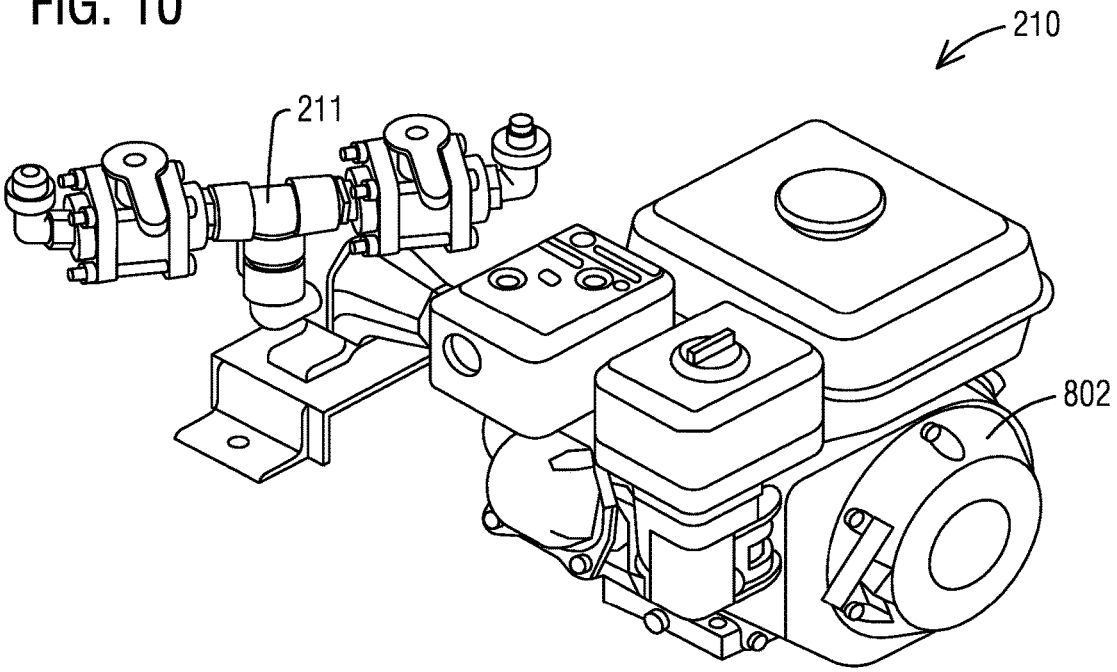
FIG. 10 is a top perspective view of a hydraulic sprayer of the system of FIG. 8, according to an embodiment.

The tank dispensing system 200 includes multiple hydraulic sprayers 210*a*-210*c*, each connected to a pair of tanks (12*a*, 12*b*), (12*c*, 12*d*), (12*e*, 12*f*) through a respective input manifold 211*a*-211*c*. Where appropriate, the system 200 will be discussed with reference to the hydraulic sprayer 210*a* and tanks 12*a*, 12*b* and the discussion similarly applies to the other hydraulic sprayers 210*b* and 210*c* and tanks (12*c*, 12*d*) (12*e*, 12*f*). For an example embodiment, FIG. 10 provides a top perspective view of the hydraulic sprayer 210 powered with a gasoline engine 802 having a seven gallon gas tank. The hydraulic sprayer 210 is exemplary, and other types of paint sprayers can be used. This illustrated configuration permits the engine in each hydraulic sprayer to run uninterrupted for an entire work day. In another example embodiment, feed lines connecting the tanks (12*a*, 12*b*) to the hydraulic sprayer 210*a* have an inside diameter in a range of ⅜" to ¼".

Figure 9:
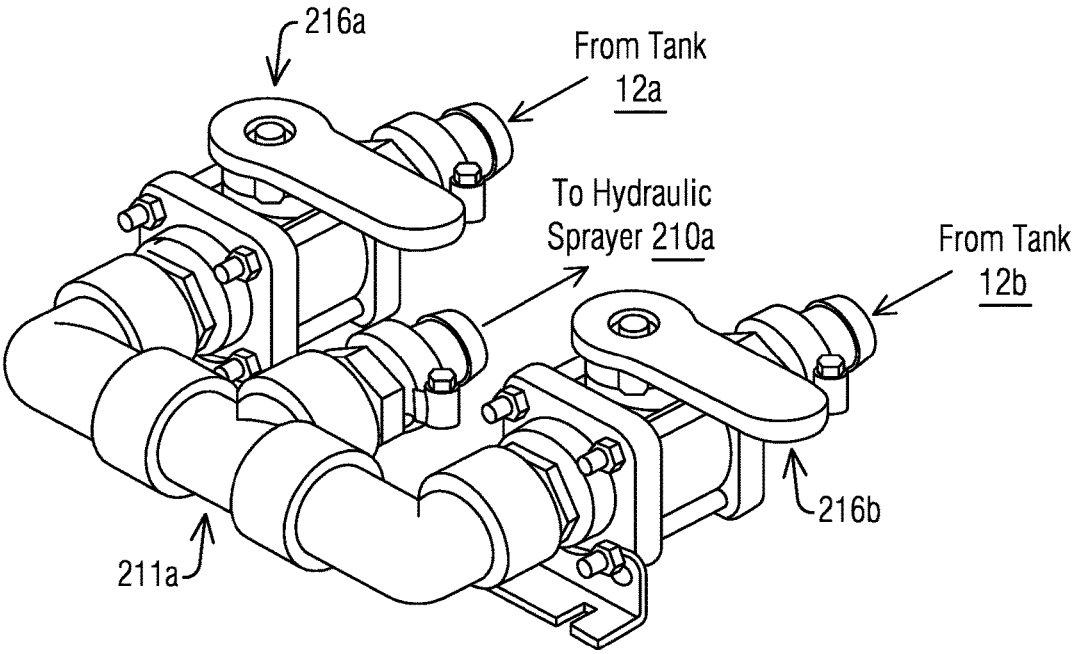
FIG. 9 is a top perspective view of an intake manifold of the system of FIG. 8, according to an embodiment.

Each tank (12*a*, 12*b*) includes a respective tank output valve 216*a*, 216*b*. FIGS. 6A-6B depict that each tank 12 includes an output 401 that directs coating material output from each tank 12 either to the output valve 216, for entry to an input manifold 211, or to a drain valve 402. The input manifold 211, generally is a multi-port input manifold to the sprayer 210, and in the illustration is connected to a pair of tank output valves 216 to receive paint from one or more of the tanks 12 depending on whether the output valve 216 of each respective tank 12 is open. When the output valve 216*a* is open and the output valve 216*b* is closed, the input manifold 211*a* only draws paint from the tank 12*a*. When the output valves 216*a*, 216*b* are both open, the input manifold 211*a* draws paint from both tanks 12*a* and 12*b*. As shown in FIG. 8, the input manifold 211 merges flow received from two output valves 216 e.g., a "T" input, for flow to one hydraulic sprayer 210. The top perspective view of the intake manifold 211 shown in FIG. 9 illustrates the two inputs of an intake manifold 211 which receive paint from the tanks 12*a*, 12*b*. The output valves 216*a*, 216*b* are opened or closed, depending on whether coating material from one or both of the tanks 12*a*, 12*b* is to be passed into the sprayer 210*a*, i.e., through the intake manifold 211*a*. The input manifolds 211*b*, 211*c* are illustrated as having the same configurations as the input manifold 211*a*. In an example embodiment, if both tanks 12*a*, 12*b* hold coating material of the same color or type, both tank valves 216*a*, 216*b* may be opened to maximize a flow rate of coating material through the hydraulic sprayer 210*a*. The output valves 216*c*, 216*d* of the tanks (12*c*, 12*d*) are connected with the intake manifold 211*b* and the output valves 216*e*, 216*f* of the tanks (12*e*, 12*f*) are connected with the intake manifold 211*c* in a similar manner as the output valves 216*a*, 216*b* are connected with the intake manifold 211*a* discussed above.

The multiple hydraulic sprayers 210*a*-210*c*, each include a pair of output lines each connected to a hose reel (228*a*, 228*b*) (228*c*, 228*d*) ((228*e*, 228*f*), providing a two output manifold hose configuration where each of two hoses 230 is stored on a separate reel 228. The term hose reel refers to a frame on which a hose 230 is stored and on which connections to the hose 230 may be effected through fittings mounted on the frame associated with the reel 228. However, a hose may be connected directly to a sprayer 210 and simply wound on a reel 228. As indicated in FIG. 5, the hose reels 228 are stored in a rear portion of the vehicle 8. The output configuration of the system 200 described for the hydraulic sprayer 210*a* and hose reels (228*a*, 228*b*) is exemplary of corresponding configurations for the hydraulic sprayers 210*b*, 210*c* and associated hose reels (228*c*,228*d*) (228*e*,228*f*).

For the hydraulic sprayer 210*a*, each hose reel (228*a*, 228*b*) includes an input valve 240*a* and 240*b* connected to receive flow from the sprayer 210*a*, i.e., providing a sprayer output manifold having two hose lines connected to simultaneously operate two spray guns. When both input valves 240*a* and 240*b* are open, the hydraulic sprayer 210*a* delivers paint to both hose reels 228*a* and 228*b*. If one input valve 240*a* is open and the other input valve 240*b* is closed, the hydraulic sprayer 210*a* only delivers paint to the hose reel 228*a* with the open input valve 240*a*. In one example configuration, an input valve 240, for hose reel 228 is closed if the hose reel 228 is not in use or becomes inoperable, e.g., in the event of a blown hose line. A first end of each hose reel 228 is connected to the input valve 240 to receive the paint, and an opposing second end of each hose reel 228 is attachable to a spray gun (not shown). In an example embodiment, the hose reels 228 have inside diameters in a range of ⅜"-½".

Although the tank dispensing system arrangement of FIG. 8 depicts six tanks 12*a*-12*f*, three hydraulic sprayers 210*a*-210*c* and six hose reels 228*a*-228*f* on the vehicle 8, this is merely an illustrative arrangement, and the invention is not so limited. The vehicle 8 may include less than or more than six tanks 12, fewer or more than three hydraulic sprayers 210, and fewer or more than six sets of hose reels 228 and hoses 230. In other configurations there may be only one tank 12, or more than two tanks 12, connected to each hydraulic sprayer 210 through output valves 216, embodiments of the manifold 211 comprising two, three or more input ports.

In other embodiments the configuration of the system 200 may provide one hose reel 228 and hose 230, or more than two hose reels 228 and hoses 230 connected to each hydraulic sprayer 210 through respective input valves 240. Each hydraulic sprayer 210 may be connected to hoses 230 of varying lengths, such as one or more relatively short hoses (i.e. first length) for use at locations close to the vehicle 8 and one or more longer lengths hose reels (i.e. second length) for use at locations more distant from the vehicle. In this example embodiment, the first length is in a range of 150' to 400' and the second length is in a range of 250' to 400'.

Figure 11:
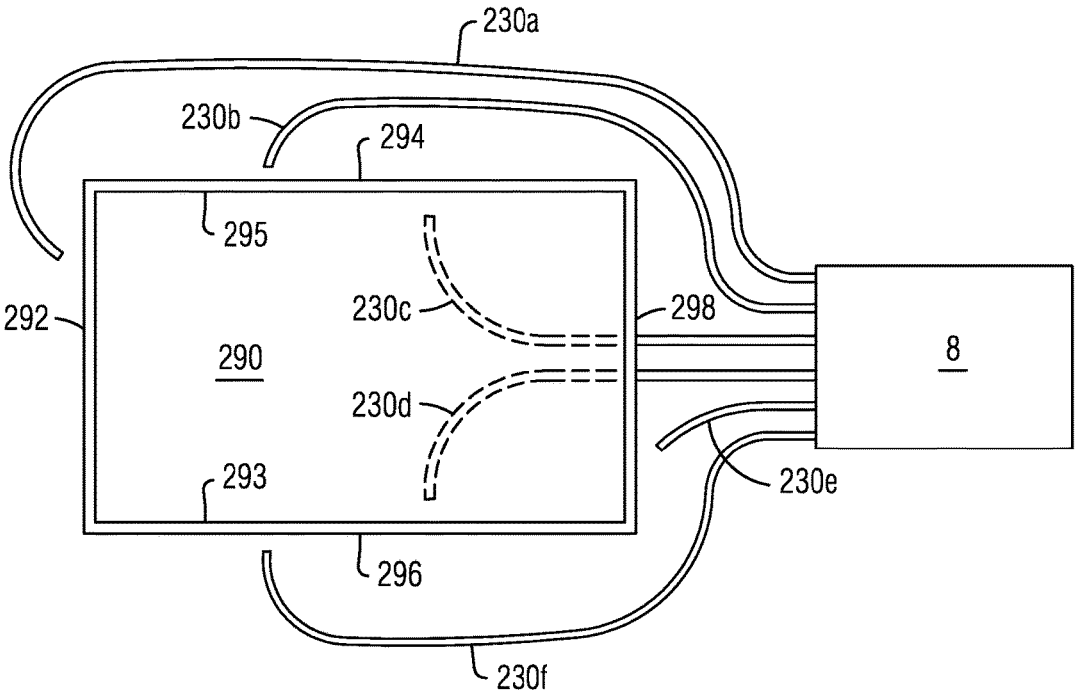
FIG. 11 a block diagram of a plurality of hoses of the system of FIG. 8 extended to a plurality of locations around a job site, according to an embodiment.

During use of the system 200, depending on the setting of the output valves 216, the paint in one or more of the tanks 12 is dispensed to the hydraulic sprayers 210. Depending on the settings of the input valves 240 shown in FIG. 8, paint or other coating material from each hydraulic sprayer 210 is dispensed through one or more of the hoses 230 for spraying. Each hose reel is of sufficient length that it can be extended from the vehicle 8 to a desired location at the job site to spray paint. In an example embodiment, the length of the hose reel can be extended up to 400 feet or more. FIG. 11 illustrates a plurality of hoses 230*a*-230*f* of the system 200 extended to a plurality of locations around a job site. As depicted in FIG. 11, multiple hoses 230 can be simultaneously extended from the vehicle 8 to multiple locations around the job site requiring painting, so that multiple workers can simultaneously spray paint delivered from multiple tanks 12*a*-12*f* through different hoses. For example, four of the hoses 230*a*, 230*b*, 230*e*, 230*f* are extendable from the vehicle 8, each to surfaces 292, 294, 296, 298 on different sides of the building 290, to simultaneously spray paint the surfaces on the different exterior sides of the building. In an example embodiment, two of the hoses 230*c*, 230*d* are also extended from the vehicle 8 to different locations within an interior of the building 290 to spray paint interior surfaces 293, 295 on different interior sides 293, 295 of the building 290. Thus a combination of six interior and exterior surfaces may be simultaneously painted about a building. Similarly, the system 200 can simultaneously apply coating material to interior or exterior surfaces on different buildings.

Figure 12:
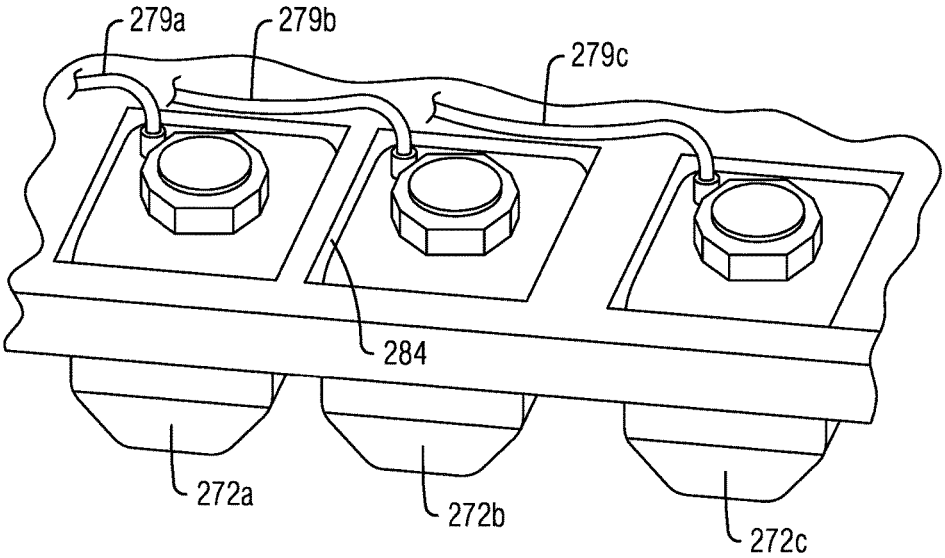
FIG. 12 is a front perspective view of an overflow tank of the system of FIG. 8, according to an embodiment.

Still referring to FIG. 8, each hydraulic sprayer 210*a*-210*c* is connected to an overflow tank 272*a*-272*c* through an overflow line 279*a*-279*c* with a primer valve 278*a*-278*c*. The hydraulic sprayer 210 operates at a high pressure, e.g., 3000-4000 psi. With the hydraulic sprayer 210 off, the primer valve 278 is opened to slowly release high pressure within feed lines between the tanks 12 and/or the hoses 230 and the hydraulic sprayer 210, and to send any paint within the feed lines into the overflow tank 272. FIG. 12 provides a front perspective view of the overflow tanks 272*a*-272*c* of the system 200. The overflow tanks 272 are each secured within a recess 284 in a side of the vehicle 8. The overflow lines 279 are secured to dispense overflow through an intake port in the top of the overflow tank 272, providing the advantage of eliminating the need for each worker to have an overflow container to release pressure from the hose line. With the overflow tanks 272 and overflow lines 279 secured, they remain stable when subjected to high pressures present in the feed lines.

During use of the paint dispensing system 200, if tanks 12*a* and 12*b* hold coating material of the same color or type the output valves 216*a* and 216*b* of tanks 12*a* and 12*b* in FIG. 8 are opened, to maximize the flow rate of paint of that color or type through the hydraulic sprayer 210*a* and through the hoses 230*a* and 230*b*. When the paint color or type in one or both of tanks 12*a* and 12*b* is subsequently changed, the feed lines between the tanks 12*a* and 12*b* and the hydraulic sprayer 210*a* and between the hydraulic sprayer 210*a* and the hose reels 228*a* and 228*b* are cleared before the new color or type of coating material is passed through the feed lines. The feed lines are cleared by the system 400 discussed below.

Figure 13:
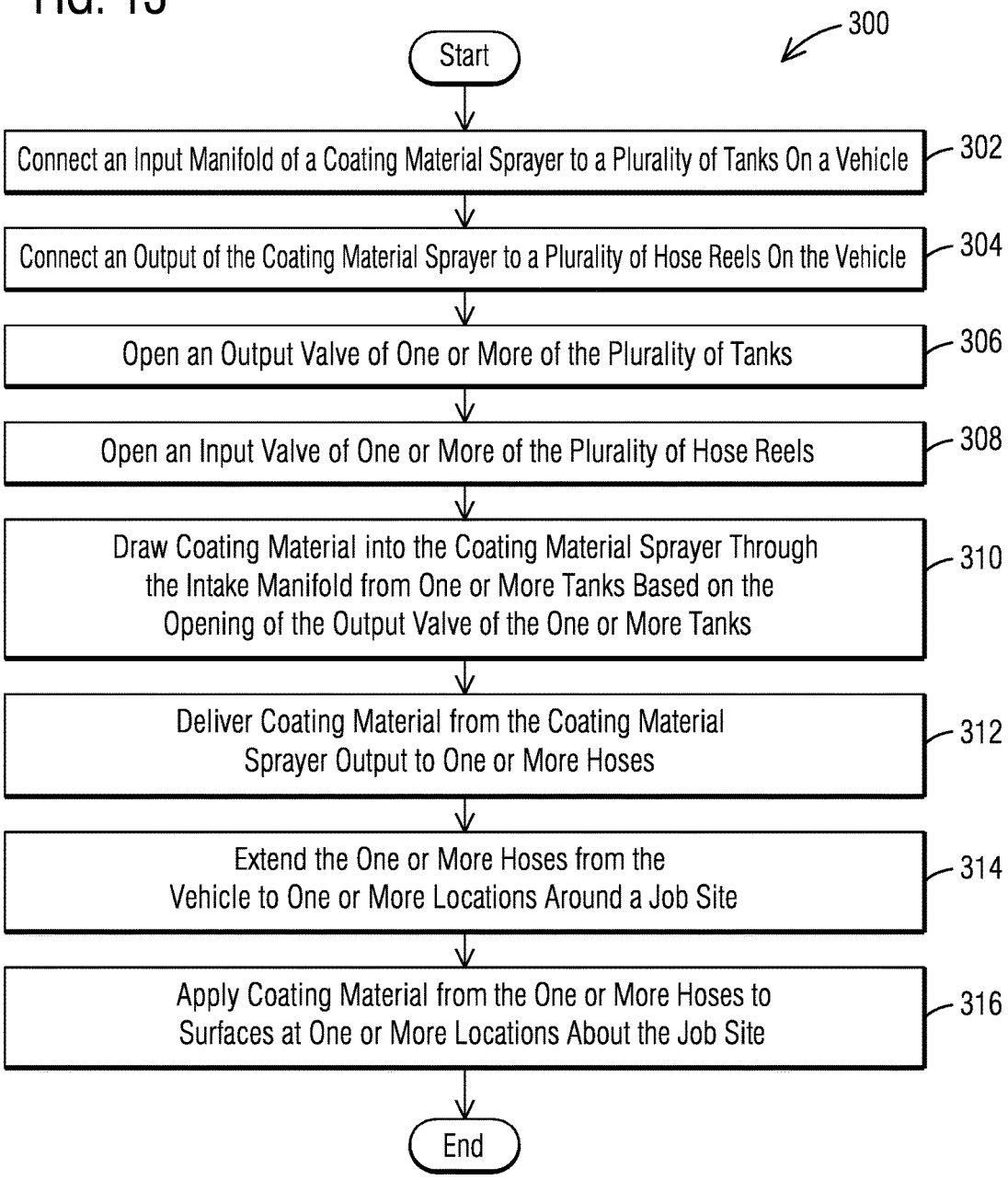
FIG. 13 is a flow diagram of a method for dispensing liquid coating material from tanks on a vehicle, according to an embodiment.

FIG. 13 is a flow diagram of a method 300 for dispensing paint or coating material from tanks 12 on the vehicle 8.

In step 302, the input manifold 211 of a paint sprayer 210 on the vehicle 8 is connected to the plurality of tanks, e.g., tanks 12*a* and 12*b* on the vehicle 8. The input manifold 211*a* of a first paint sprayer 210*a* is connected to a first plurality of tanks 12*a* and 12*b* and the input manifold 211*b* of a second paint sprayer 210*b* is connected to a second plurality of tanks 12*c* and 12*d* on the vehicle 8, where the first and second plurality of tanks 12*a*-12*d* have been filled with coating materials to a desired level 54.

In step 304, an output of the paint sprayer 210 is connected to the plurality of hoses, e.g., hoses 230*a* and 230*b* on the vehicle 8. The output of the first paint sprayer 210*a* is connected to a first plurality of hoses 230*a* and 230*b* and the output of the second paint sprayer 210*b* is connected to a second plurality of hoses 230*c* and 230*d* on the vehicle 8.

In step 306, the output valves 216 of certain ones of the one or more of the tanks 12 are opened, e.g., based on determination as to which tanks 12 the coating material is to be drawn from and passed through the input manifold 211. If paint should be drawn from both tanks in an intake manifold, e.g., tanks 12*a* and 12*b*, both output valves 216*a* and 216*b* are opened. If paint should only be drawn from tank 12, then only the output valve 216 for that tank 12 is opened. Step 306 includes opening the output valves 216*a*, 216*b* of one or more of the first plurality of tanks, e.g., tanks 12*a* and 12*b* and may further include opening the output valves 216*c* and 216*d* of one or more of the second plurality of tanks 12*c* and 12*d*.

In step 308, the input valves 240 of applicable hoses 230 are opened, e.g., input valves 240*a* and 240*b* are opened to supply coating material to the hoses 230*a* and 230*b* from the hydraulic sprayer 210*a*. When coating material should be delivered to both hoses 230*a*, 230*b*, both input valves 240*a* and 240*b* are opened. When coating material should only be delivered to one hose 230, then only the input valve 240 for that hose is opened. Step 308 includes opening the input valves 240*a* and 240*b* of one or more of the first plurality of hoses 230*a* and 230*b* and opening the input valves 240*c* and 240*d* of one or more of the second plurality of hoses 230*c* and 230*d*.

In step 310, paint is drawn into a paint sprayer 210 through the intake manifold 211 from one or more tanks 12 based on opening of output valves in step 306. For example, paint may be drawn into the first paint sprayer 210*a* through the intake manifold 211*a* from one or more tanks 12*a* and 12*b* and paint is drawn into the second paint sprayer 210*b* through the intake manifold 211*b* from one or more tanks 12*c* and 12*d*, based on step 306.

In step 312, paint is delivered from the paint sprayer output to one or more of the hoses 230, based on selective opening of input valves in step 308. For example, paint may be delivered from the first paint sprayer 210*a* as an output to one or more of the hoses 230*a* and 230*b*, and paint may be delivered from the second paint sprayer 210*b* as output to one or more of the hoses 230*c* and 230*d*, based on step 308.

In step 314, with one or more of the hoses 230 extended from the vehicle 8 to one or more locations around a job site to one or more first locations around the job site, as depicted in FIG. 11, the hose reels 230 are extended to locations around an exterior of the building 290 and to locations within an interior of the building 290.

In step 316, coating material is then sprayed from the one or more hoses 230 positioned at the one or more locations, e.g., from the one or more of the first hoses 230*a* and 230*b* and from the one or more of the second hoses 230*c* and 230*d* at the one or more second locations. See FIG. 11, which illustrates positioning for spraying on exterior surfaces 292, 294 of the building 290 and on interior surfaces 293, 295 within the building 290.

Figure 14:
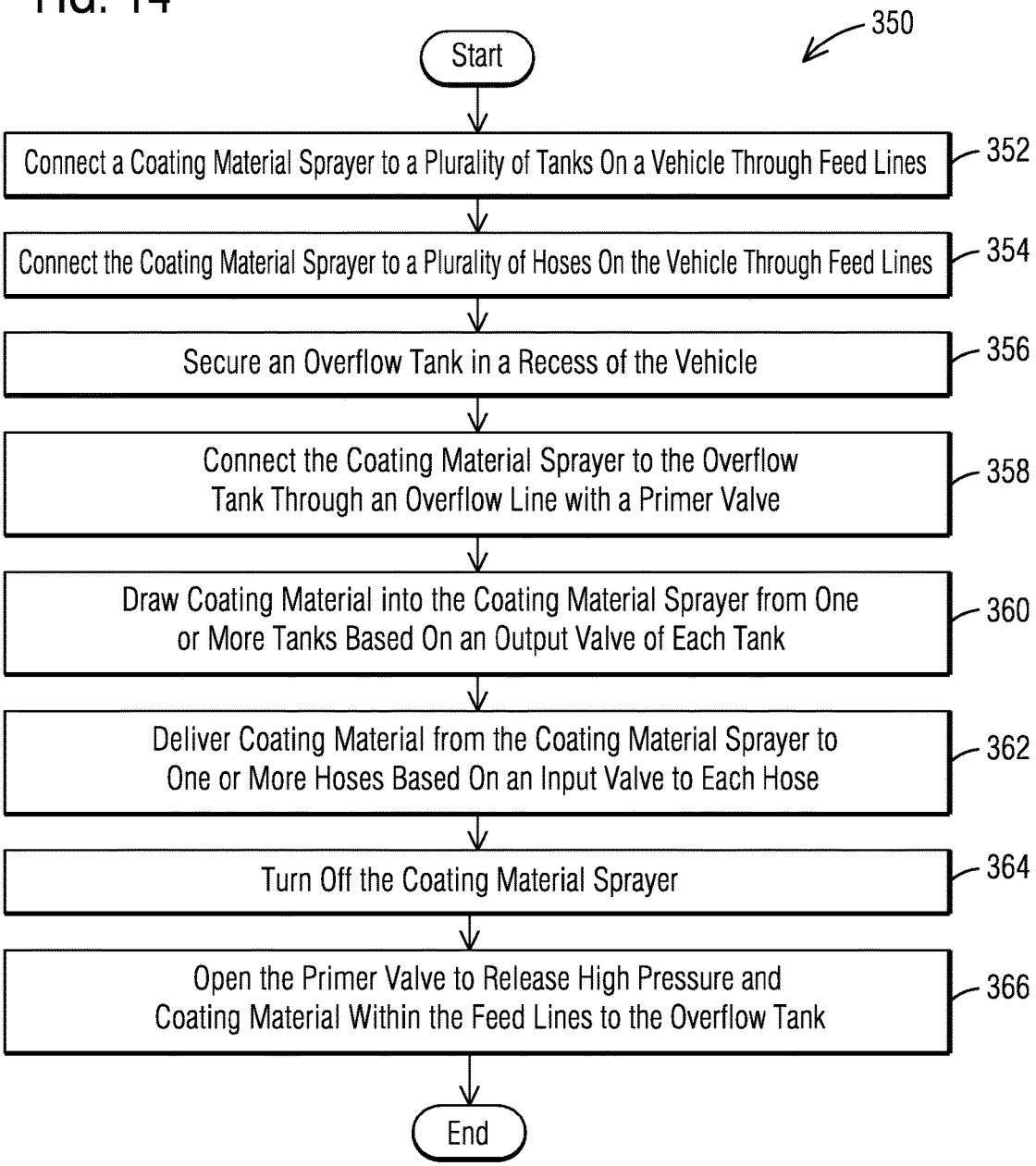
FIG. 14 is a flow diagram of a method for dispensing liquid coating material from tanks on a vehicle, according to an embodiment.

FIG. 14 is a flow diagram of a method 350 for dispensing paint from tanks on the vehicle 8. Steps 352 and 354 are similar to steps 302 and 304 discussed above. In step 356, the overflow tanks 272 are secured to the vehicle 8. In an example embodiment, in step 356, the overflow tanks 272 are each secured in respective recesses 284 in a side of the vehicle 8.

In step 358, the paint sprayer 210 is connected to the overflow tank 272 through the overflow line 279 with the primer valve 278. In accord with step 358, the overflow line 279 may be connected to an intake port in a top of the overflow tank 272. Generally, the paint sprayers 210*a*-210*c* may be connected to the overflow tanks 272*a*-272*c* through the overflow lines 279*a*-279*c* by opening primer valves 278*a*-278*c*.

Steps 360 and 362 are similar to steps 310 and 312 discussed above. In step 364, one or more paint sprayers 210 are turned off, e.g., after completion of step 362, which may correspond to completion of a work session. According to step 366, one or more of the primer valves 278*a*-278*c* are opened to release pressure and coating material (i) within feed lines between the tanks 12 and hydraulic sprayers 210 or (ii) within feed lines between the hoses 230 and hydraulic sprayers 210, to send material to the overflow tank 272.

Figure 15:
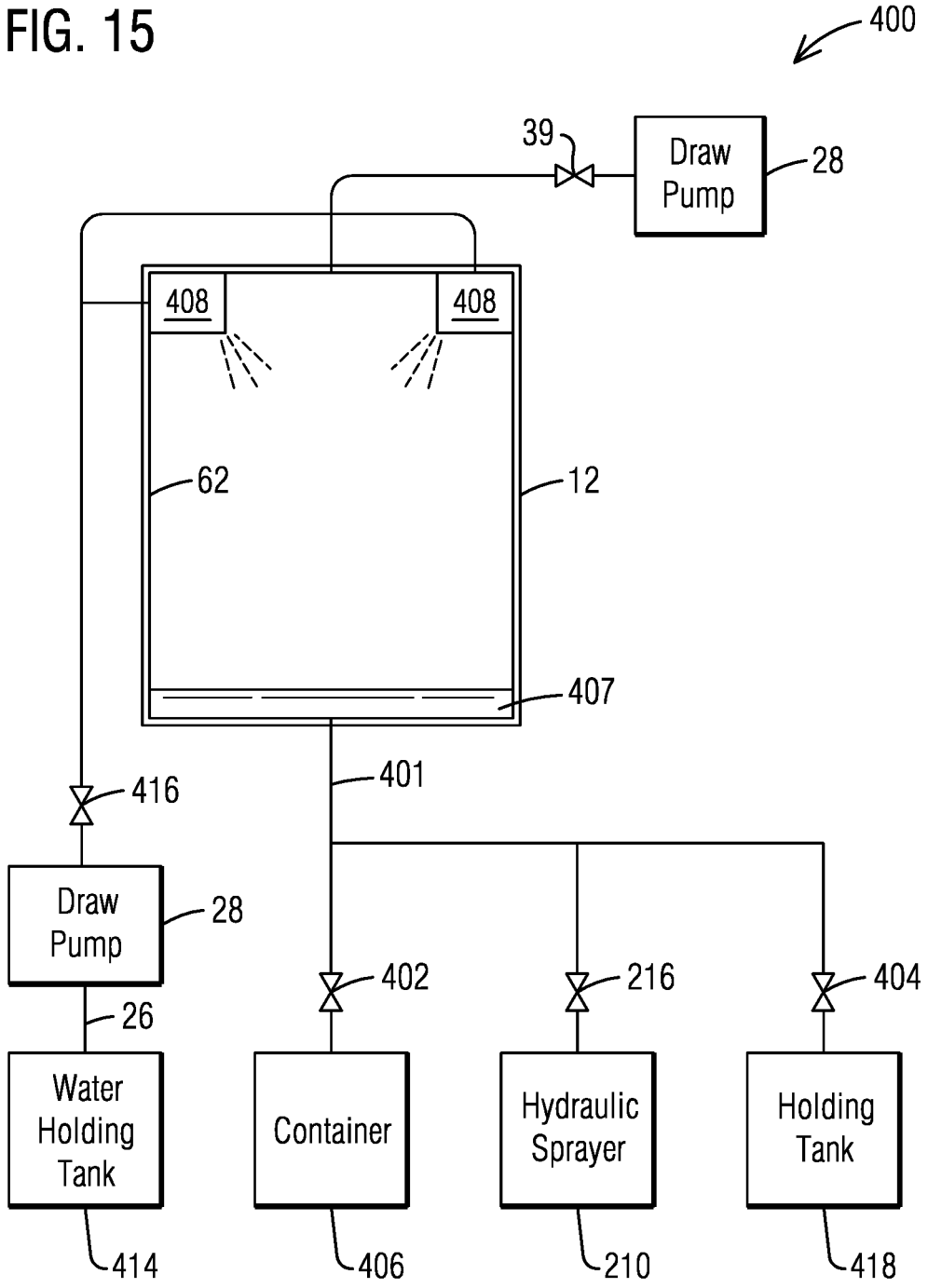
FIG. 15 is a block diagram that illustrates an example of a system for cleaning tanks on a vehicle, according to an embodiment.

FIG. 15 is a schematic diagram of a system 400 for cleaning interior surfaces 62 of the tanks 12*a*-12*f*. Cleaning of a single tank 12 is discussed, but the arrangement is applicable to all tanks 12*a*-12*f*. When a coating material present in the tank 12 needs to be removed, e.g., changed from a first type to a second type, the cleaning system 400 cleans the tank 12 and clears out the feed lines used by the first coating material. The system 400 is a circulating wash system for removing a first coating material from the tank and feed lines before a second coating material is placed in the tank 12.

Figure 16:
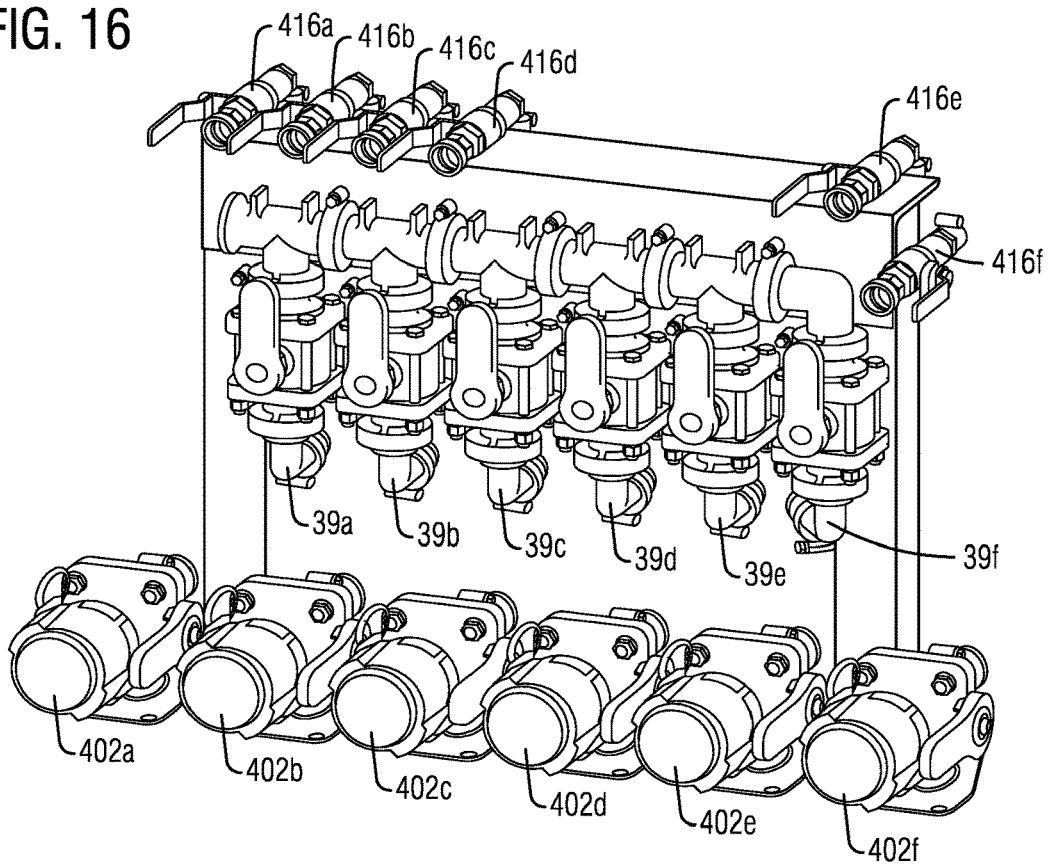
FIG. 16 is a perspective view that illustrates an example of water intake valves of the system of FIG. 15, according to an embodiment.

The tank 12 includes an input fill valve 39 and the output line coupled to three output valves arranged in parallel (drain valve 402, output valve 216, holding tank valve 404). The output line 401 is also shown in FIG. 6. In other embodiments the tank 12 may include multiple input valves or fewer or more than three output valves. The input valve 39, shown in FIG. 1, is used to fill the tank 12 with coating material. One of the output valves from the tank is the valve 216, also associated with the tank dispensing system 200, through which coating material flows to the hydraulic sprayer 210 for dispensing through one or more hoses 230 to the spray guns. Other output valves from the tank 12 are the drain valve 402 and the holding tank valve 404, each also used in the cleaning system 400. The perspective view of FIG. 16 illustrates the series of fill valves 39 and drain valves 402.

Figure 17:
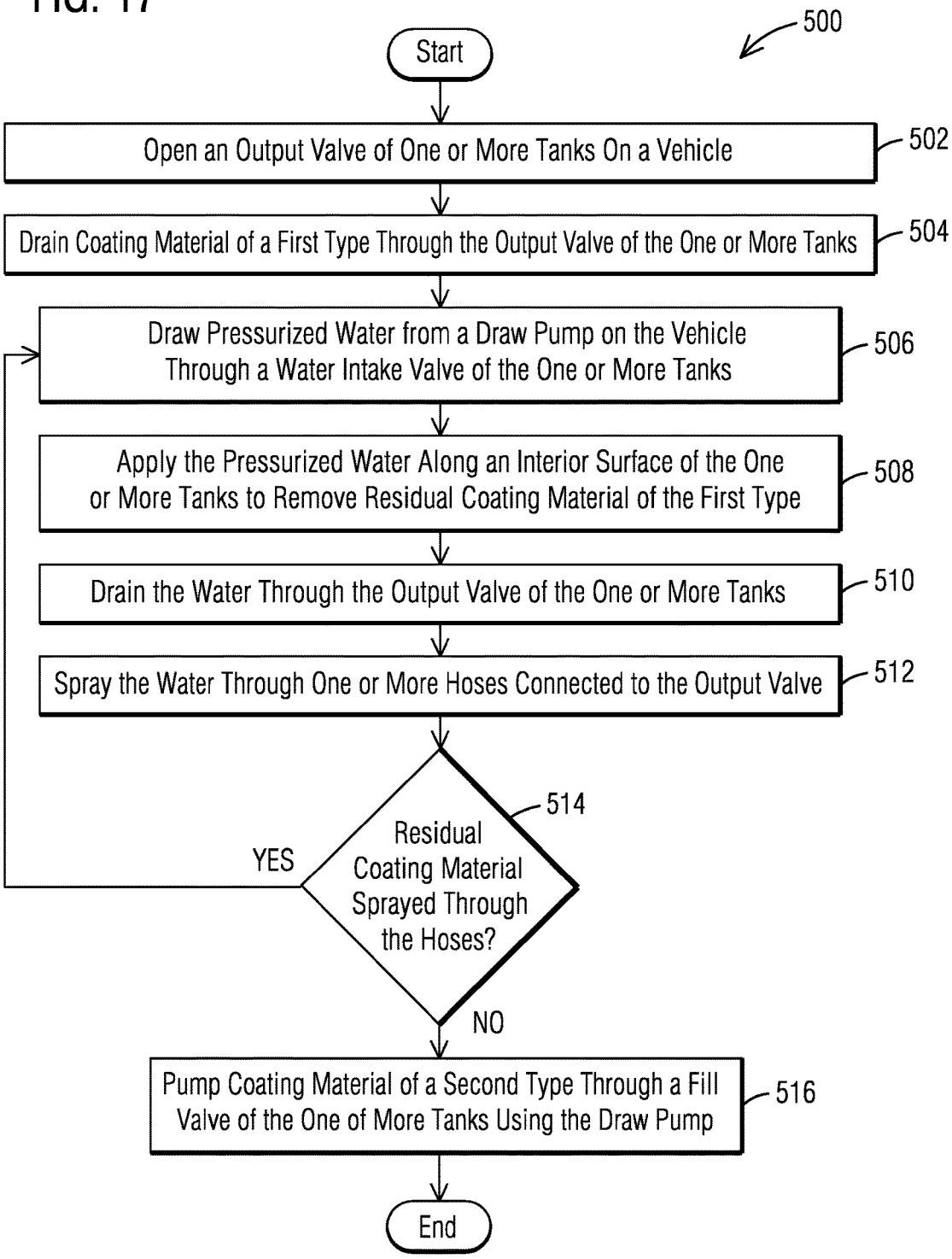
FIG. 17 is a flow diagram that illustrates an example of a method for cleaning tanks on a vehicle, according to an embodiment.

The flow diagram of FIG. 17 illustrates an example method 500 for cleaning one or more tanks on the vehicle 8. While the method 500 is described with reference to a single tank 12, it is applicable to all of the tanks 12*a*-12*f*. In step 502, an output valve of the tank 12 is opened. In an example embodiment, the drain valve 402 of the tank 12 is opened. In step 504, any remaining coating material 407 of a first type in the tank 12 is drained through the output valve opened in step 502. The remaining coating material 407 of the first type in the tank 12 passes through the drain valve 402 and into a container 406 such as a five-gallon container. The tank drain valve 402 is then closed. However, even after performing steps 502 and 504, draining the first coating material 407 into the container 406, residual coating material of the first type normally remains along the inside surfaces 62 of the tank 12, and this is removed by the system 400.

In step 506, pressurized water, provided in a holding tank 414, is drawn with the pump 28 through a wash water intake valve 416. See, also, FIG. 16. The tank 414 may have a 60 gallon capacity. To operate the system 400, a feed line from the draw pump 28 is connected to the wash water intake valve 416 and the wash water intake valve 416 is opened. Each tank 12*a*-12*f* includes a wash water intake valve which is opened when the tank is being cleaned according to a method 500. With the draw tube 26 of the draw pump 28 placed in the holding tank, the needed water from the holding tank 414 is drawn through the tube 26 by the pump 28 and pressurized by the draw pump 28.

In step 508, the pressurized water is applied along the inside surface 62 of the tank 12 to remove residual coating material of the first type. When a valve 416 is opened, pressurized water is delivered from the draw pump 28 and to a water delivery system 408 to circulate water along the inside surface 62 of the tank 12. In an example embodiment, the water delivery system 408 is a circulating sprinkler system. During step 508, residual coating material of the first type is cleaned from the inside surface 62 of the tank 12 by injecting water tangentially along the inside surface 62 with a circulating or circumferential flow, consequently rinsing any residual coating material of the first type off the inside surface 62 of the tank 12. In an example embodiment, the draw pump 28 is activated for a minimum time period to apply the water during step 508, such as, for example, 5 minutes.

In step 510, the water applied along the inside surface 62 of the tank 12 in step 508 is drained through an output valve of the tank 12. In an example embodiment, in step 510, the output valve 216 is opened and the rinse water circulated along the inside surface 62 of the tank 12 is passed through the opened output valve 216 and to the hydraulic sprayer 210.

In step 512, the hydraulic sprayer 210 is activated and the rinse water drained in step 510 through the opened output valve 216 is sprayed through a spray gun on an end of a hose 230 of one or more hose reels 228. This step 512 clears the hose lines 230 of hose reels 228 of the coating material of the first type.

In step 514, a determination is made during step 512 whether residual coating material of the first type continues to flow through the spray coming through the spray gun on the end of the hoses 230. If only water is observed being sprayed through the spray gun on the end of the hoses 230 during step 512, the determination in step 514 is negative and the method 500 proceeds to step 516. If residual coating material of the first type is observed mixed with the water sprayed through the spray gun on the end of the hoses 230 during step 514, the determination in step 514 is positive and the method 500 proceeds to step 506 and steps 506-514 are repeated.

In step 516, the tank 12 is filled with coating material of a second type according to the method 100.

In an example embodiment, the holding tank valve 404 is opened and the rinse water which was circulated along the inside surface 62 of the tank 12 is passed to a gravity fed holding tank 418 on the vehicle 8. After the rinse water is passed into the holding tank 418, steps 506 and 508 are performed, and in step 510 the holding tank valve 404 is closed, the output valve 216 is opened, and the water is passed to the hydraulic sprayer 210. In step 512, the hydraulic sprayer 210 is activated to spray the rinse water through spray guns on an end of one or more of the hoses 230. This step 512 clears the hose lines 230 of the coating material of the first type and also simultaneously involves the step 514 determination of whether residual coating material is in the water sprayed from the hose lines 230. In one example embodiment, the system 400 need not include the holding tank valve 404 and may dispense the rinse water from the tank 12 through the output valve 216 and the hoses 230, without draining rinse water into the holding tank 418.

Figure 18:
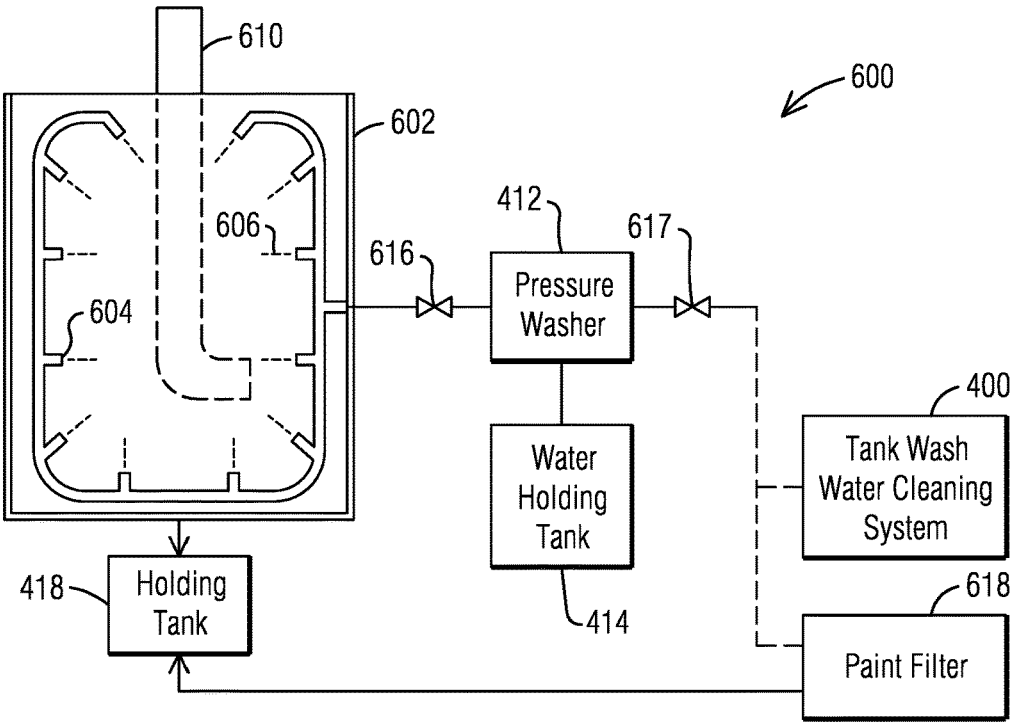
FIG. 18 is a block diagram that illustrates an example of a system for cleaning a nozzle of a paint spray gun, according to an embodiment.

FIG. 18 illustrates a system 600 for cleaning a nozzle of a paint spray gun. After using the tank dispensing system 200 to dispense coating material from spray guns at the end of the hoses 230, residual coating material has typically built up on an inside of the nozzle or safety housing and tip of the spray gun. Conventionally, nozzle cleaning operations have introduced water which passes through the hoses 230 and through the nozzle, i.e., from the fluid passage on the inside of the spray gun. With the water passing along the inside of the spray gun, it has been determined that this method of cleaning does not completely remove the residual coating material on the inside of the nozzle in regions along the location of the tip. An inability to more completely clean the nozzles of the spray guns results in the nozzle tips having to be discarded, which is costly. The nozzle cleaning system 600 cleans the nozzles with high pressure water impinging surfaces of the nozzle tips from outside of the spray gun. This method and design of cleaning has been found more effective at dislodging residual coating material on the inside of the nozzle tips than conventional cleaning methods. With a nozzle cleaning system that can more effectively clean the nozzles, the useful life of nozzle tips is extended, and the tips need not be discarded with such limited use, thereby providing considerable cost savings.

Figure 19:
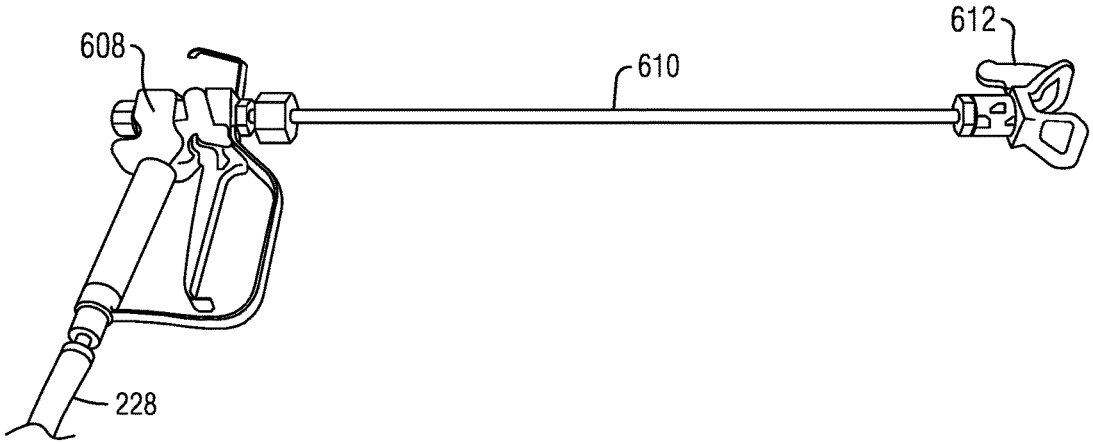
FIG. 19 is a side view that illustrates an example of the paint spray gun nozzle that is cleaned by the system of FIG. 18, according to an embodiment.

FIG. 18 depicts the nozzle cleaning system 600, including an open canister 602 of cylindrical or rectangular shape having a series of water spray orifices 604 along the interior of the canister 602 that eject water 606 at a high velocity within the interior of the canister 602. For example, the open canister 602 features four water spray orifices 604 along the interior of the canister 602 to eject water 606 at the high velocity. In an example embodiment, the canister 602 receives high pressure water, e.g., at 4,000 psi, from a pressure washer 412 which draws water from the holding tank 414. FIG. 19 provides a side perspective view of a spray gun 608 attached to a hose 230, with an extension wand 610 positioned between the spray gun 608 and the nozzle 612. With the paint spray gun nozzle 612, including the tip, attached to the wand 610, the nozzle is extended into the canister for cleaning by the system 600.

Figure 21:
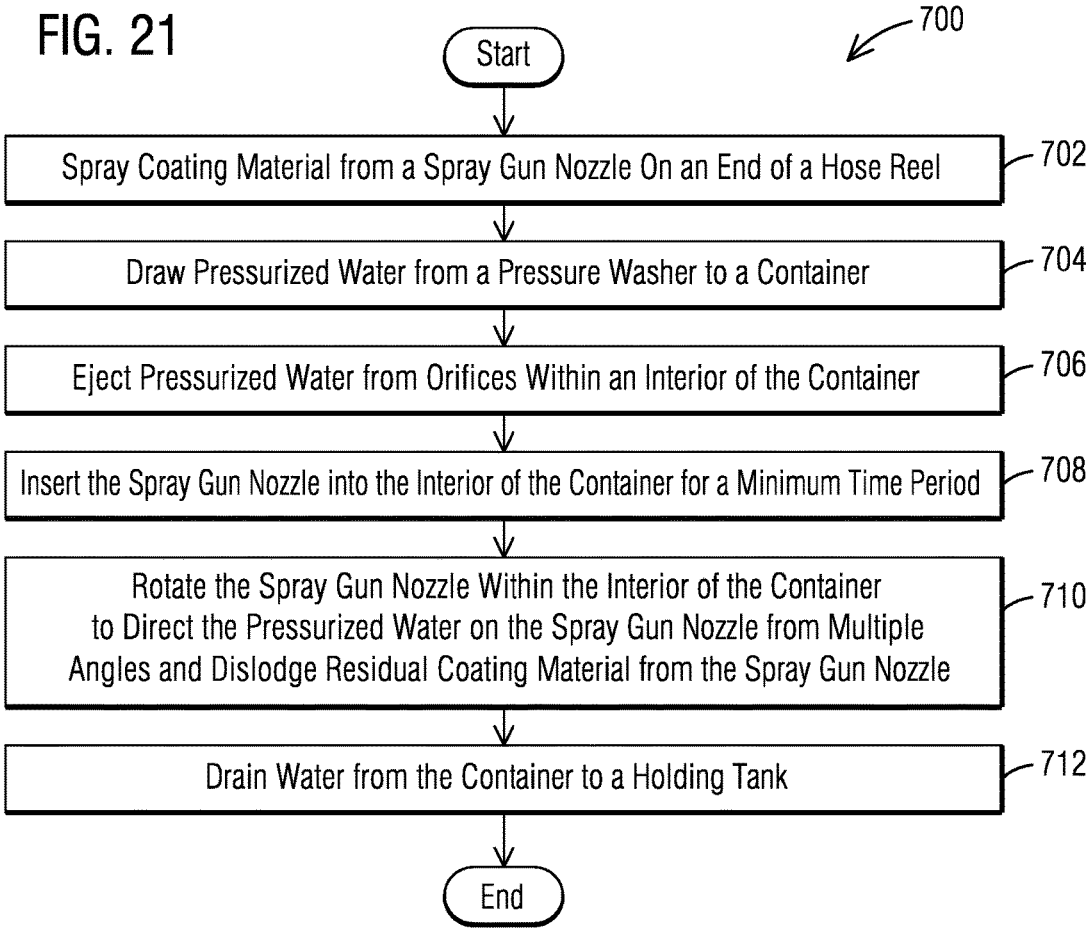
FIG. 21 is a flow diagram that illustrates an example of a method for cleaning the nozzle of the paint spray gun, according to an embodiment.

FIG. 21 is a flow diagram of a method 700 for cleaning the nozzle 612 of the paint spray gun 608. In step 702, coating material is sprayed from the nozzle 612 on the end of the spray gun 608 such as with the method 300. To facilitate nozzle cleaning, following step 702, after spraying coating material the hose 230 may be wound on the reel 228 (e.g., with a motorized drive) until the hose 230 reaches a minimum distance from the vehicle 8, e.g., 15 feet, to position the spray gun for cleaning with the system 600. This enables effective cleaning of the nozzle 612 immediately after use at the job site.

In step 704, pressurized water is drawn from the pressure washer 412 into the open canister 602. Next, in step 704, the pressure washer 412 is activated and a first valve 616 is opened to permit the pressurized water to pass through the orifices 604.

In step 706, pressurized water 606 is ejected within the interior of the canister 602. In step 708, the spray gun nozzle 612 is inserted into the interior of the open canister 602 for a minimum time period which may range from one to two minutes. The cleaning process may be performed with the nozzle 612 attached to the extension wand 610 and the nozzle inserted into the canister 602. It is not necessary to remove the nozzle 612 from the spray gun 608 in order to clean the nozzle.

In step 710, the spray gun nozzle 612 is rotated within the interior of the container to direct the pressurized water ejected during step 706 on the spray gun nozzle 612 from multiple angles and dislodge residual coating material from the spray gun nozzle 612. The extension wand 610 and nozzle 612 may be rotated within the interior of the open canister 602. In other embodiments, jets of pressurized water may rotate about the nozzle 612.

Step 710 is performed during the minimum time period of step 708 (i.e. during the time period when the spray gun nozzle 612 is inserted within the open canister 602). In an advantageous design, multiple instances of ejected water 606 are simultaneously provided from multiple angles to dislodge the residual coating material along the inside of the nozzle 612. This may involve rotating the nozzle 612 both clockwise and counterclockwise within the canister 602 to assure all portions of the nozzle 612 receive necessary amounts of the high pressure water 606 spray from all relevant angles of incidence to assure complete cleaning of the nozzle 612.

In step 712, water is drained from the open canister 602 to the holding tank 418. In an example embodiment, in step 712, water is drained from the to the holding tank 418.

As depicted in the system 600 of FIG. 18, in an example embodiment, when a second valve 617 is open, the pressure washer 412 is used to perform various tasks, such as cleaning components other than the spray nozzle 612. In one example embodiment, FIG. 18 depicts that the pressure washer 412 provides pressurized water to the cleaning system 400 within the tank 12, for purposes of cleaning the inside surface 62 of the tank 12 before the tank 12 is filled with a new coating material. The pressure washer 412 may also be used to clean in-line paint filters 618 that are removable from the hydraulic sprayer 210 of FIG. 8.

Figure 20:
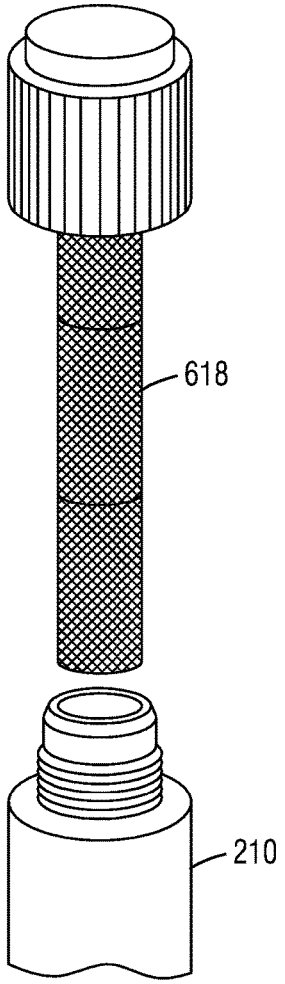
FIG. 20 is a side view that illustrates an example of a paint filter that is cleaned by the system of FIG. 18, according to an embodiment.

FIG. 20 is a side view of the paint filter 618 is removed from the hydraulic sprayer 210 for cleaning by the pressure washer 412 in the system 600. The pressure washer 412 may be adjusted to a low velocity/pressure setting when it is used to clean the paint filter 618. As the paint filter 618 is cleaned by the pressure washer 412, water is also drained to the holding tank 418.

Figure 22:
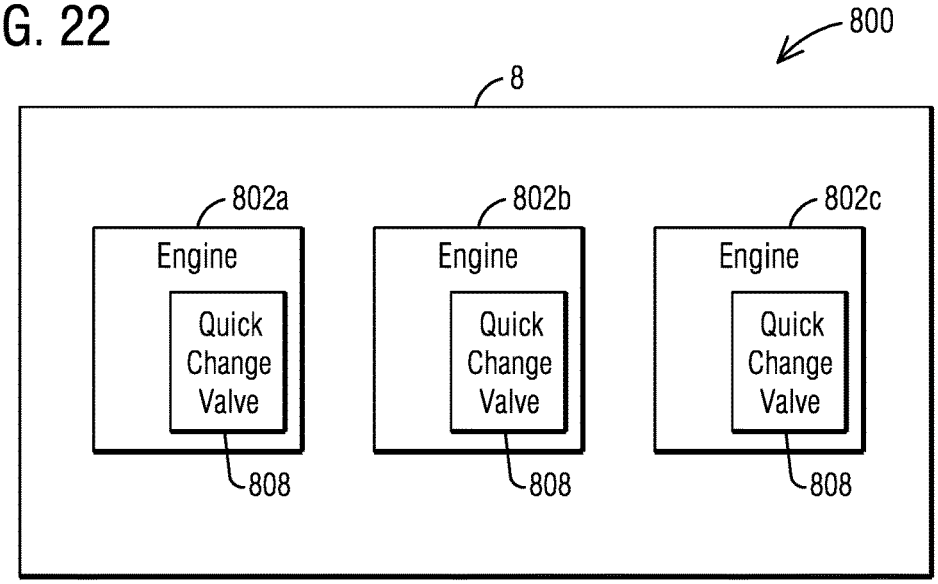
FIG. 22 is a block diagram that illustrates an example of a system for changing oil in a plurality of paint sprayer engines on a vehicle, according to an embodiment.

The hydraulic sprayers 210 used in the tank dispensing system 200 of FIG. 8 each include a gas engine 802 shown in FIG. 10, and thus require regular oil changing. In an example embodiment the gas engine 802 of the hydraulic sprayer 210 may require oil changing once per month. FIG. 22 is a block diagram of a system 800 for changing oil in a plurality of paint sprayer engines 802*a*-802*c* on the vehicle 8. As illustrated in FIG. 22, the oil changing system 800 includes a quick change valve 808 for each engine 802.

Figure 23A:
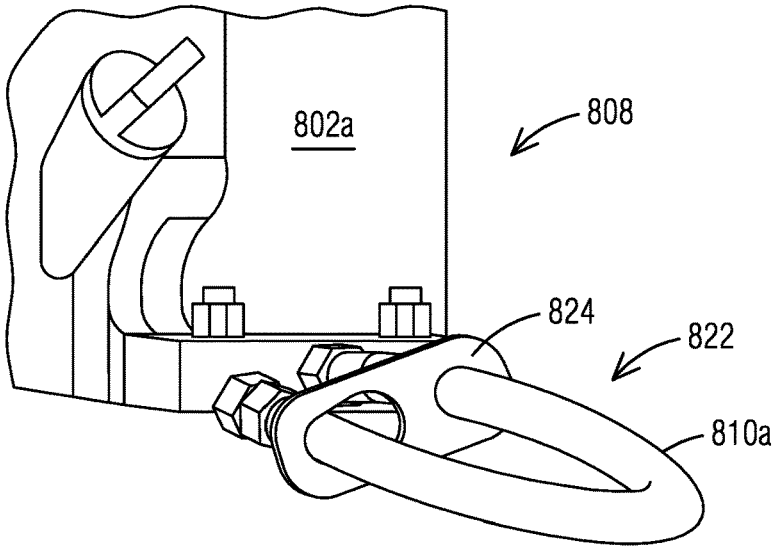
FIG. 23A is a perspective view that illustrates an example of a hose attached to the paint sprayer engine in the system of FIG. 22 in a retracted position, according to an embodiment.
Figure 23B:
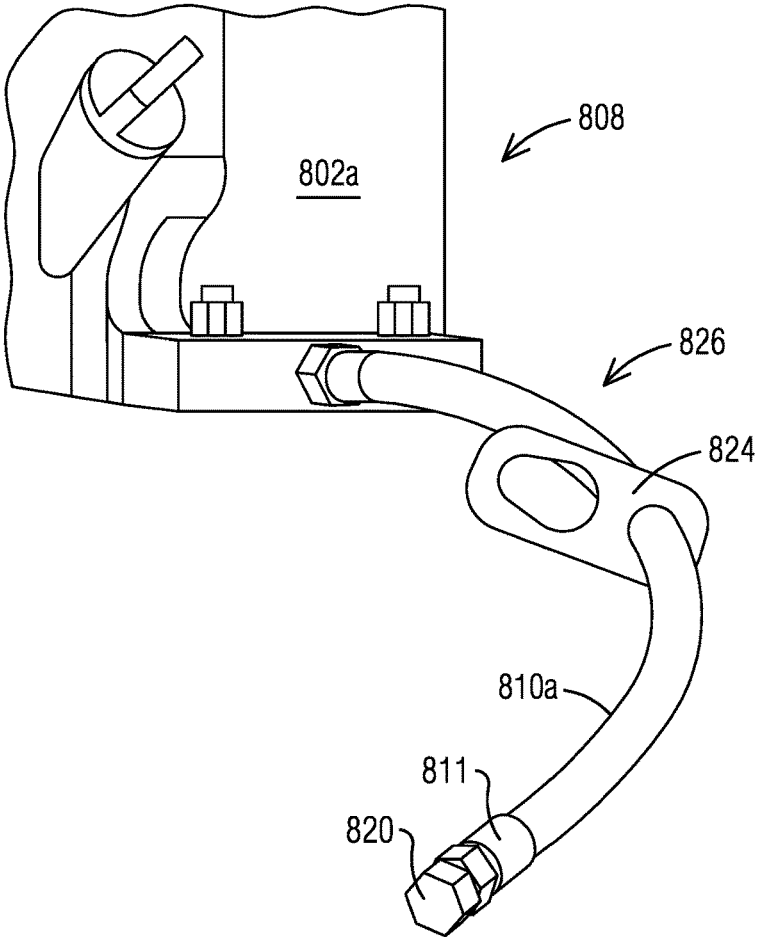
FIG. 23B is a perspective view that illustrates an example of a cut off valve on an end of the hose of FIG. 23A in an extended position, according to an embodiment.

FIG. 23A is a perspective view of the quick change valve 808 including a hose 810 attached to the paint sprayer engine 802. As illustrated in FIG. 23A, the quick change valve 808 includes the hose 810 with a threaded fitting on a first end that is secured to a threaded opening on the engine 802 for discharging oil. The threaded opening on the engine 802 is used to secure a conventional drain plug. FIG. 23B is a perspective view of a cut off valve 820 on an end of the hose 810 of FIG. 23A. In an example embodiment, the cut off valve 820 opens or closes, by rotating the valve 820, to drain oil from the engine 802. In an example embodiment, the cut off valve 820 is secured to the hose 810 using a hose clamp 811. FIG. 23A depicts the hose 810 in an initially retracted position 822. In an example embodiment, in the retracted position 822, the hose 810 is folded up and held by a clip 824. The hose 810 is positioned in the retracted position 822 during the operation of the engine 802 and the paint sprayer 210. FIG. 23B depicts the hose 810 in an extended position 826 such as when the engine 802 is turned off and the oil in the engine 802 needs to be changed, at which time the hose 810 is removed from the clip 824 and unfolds to move from the retracted position 822 (FIG. 23A) to the extended position 826 (FIG. 23B). The cut off valve 820 is then positioned over a container or a drain (not shown) and the exemplary cut off valve 820 is rotated, to discharge the oil from the engine 802 into the container or the drain.

Figure 24:
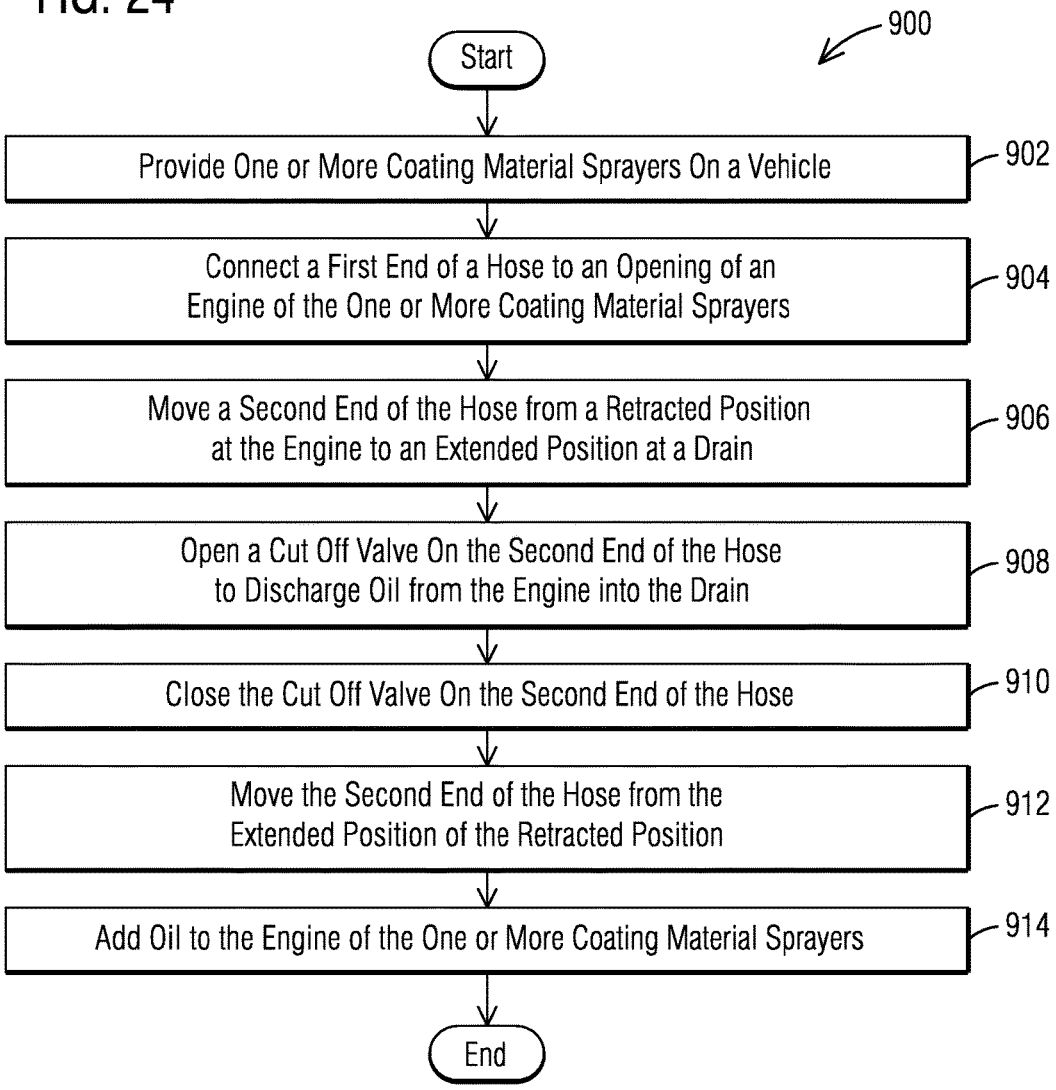
FIG. 24 is a flow diagram that illustrates an example of a method for changing oil in a plurality of paint sprayer engines on a vehicle, according to an embodiment.

The flow diagram of FIG. 24 describes a method 900 for changing oil in a plurality of paint sprayer engines 802*a*-802*c* on the vehicle 8. In step 902, one or more paint sprayers 210 are provided on the vehicle 8. In step 902, three paint sprayers 210*a*-210*c* are provided on the vehicle 8. However, step 902 is not limited to any specific number of paint sprayers.

In step 904, the first end of the hose 810 is connected to an oil discharge opening in the engine 802 of the paint sprayer 210. In this example, the threaded fitting 812 on the first end of the hose 810 is connected to the threaded opening on the engine 802.

In step 906, the second end of the hose 810 is moved from the retracted position 822 at the engine 802 to the extended position 826 at a drain or a container. In step 908, the cut off valve 820 on the second end of the hose is opened to discharge oil from the engine 802 into the drain or the container. In step 910, after the oil has been discharged from the engine 802 into the drain or the container, the cut off valve 820 is rotated to a closed position.

In step 912, the second end of the hose 810 is moved from the extended position 826 to the retracted position 822, e.g., by folding the hose 810 to the retracted position 822 using the clip 824. In step 914, oil is added to the engine 802 of the paint sprayer 210.

The oil changing system 800 provides a relatively clean and fast means for emptying oil from the engine 802 into a container or a drain. In contrast to this, conventional oil changing systems include a threaded oil change plug on the engine 802 housing which discharge oil around the engine 802 housing upon rotating the drain plug, and thus frequently require clean up. FIG. 22 depicts that the vehicle 8 includes multiple engines 802*a*-802*c*, where each engine 802*a*-802*c* is fitted with the quick change valve 808, as discussed above, for permanent attachment to the threaded opening on the engine 802 for efficient discharge of the oil into a container or a drain.

Figure 25:
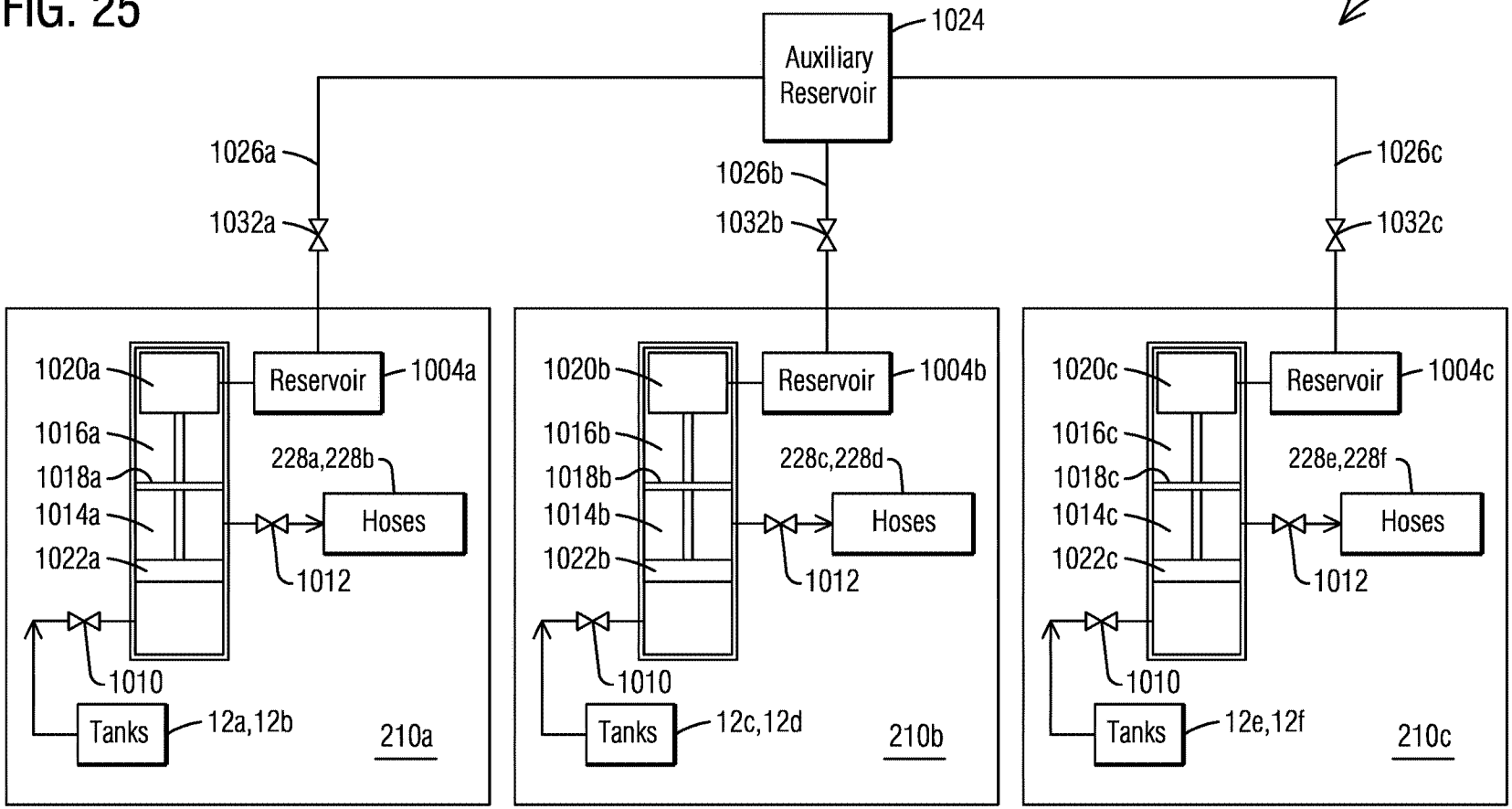
FIG. 25 is a block diagram that illustrates an example of a system for refilling an oil reservoir in a plurality of paint sprayer engines on a vehicle, according to an embodiment.

FIG. 25 is a block diagram of a system 1000 for refilling a reservoir 1004*a*-1004*c* in the paint sprayers 210*a*-210*c* on the vehicle 8. To illustrate the system, operation of one paint sprayer 210 is described, but all of the paint sprayers 210*a*-210*c* include the same arrangement. FIG. 25 depicts the hydraulic sprayer 210 of the tank dispensing system 200 of FIG. 8, with a piston 1022 and reservoir 1004 within the hydraulic sprayer 210. With paint directed into the hydraulic sprayer 210 from the tanks 12 and paint directed out of the hydraulic sprayer 210 to the hoses 230, FIG. 25 depicts the hydraulic sprayer 210 as including an upper chamber 1016 and a lower chamber 1014 separated by a gasket 1018. The hydraulic sprayer 210 includes an input valve 1010 and output valve 1012 for each piston 1022, where the input valve 1010 is opened and the output valve 1012 is closed when the piston 1022 moves up, to draw paint into the lower chamber 1014. When the piston 1022 moves down, the input valve 1010 is closed and the output valve 1012 is opened, to push paint out of the lower chamber 1014 and through the hoses 230. The gasket 1018 or seal separates the lower chamber 1014 from the upper chamber 1016 where a piston cylinder 1020 is actuated and lubricating oil is delivered from the reservoir 1004 to the upper chamber 1016. The gasket 1018 or seal separates the paint in the lower chamber 1014 to prevent the paint from mixing with the lubricating oil in the upper chamber 1016.

The reservoir refill system 1000 includes an auxiliary reservoir 1024 positioned above the three hydraulic sprayers 210*a*-210*c*, each with a line 1026*a*, 1026*b* and 1026*c* connected to each reservoir 1004*a*-1004*c* in each hydraulic sprayer 210*a*-210*c*, for purposes of refilling each reservoir 1004*a*-1004*c*. Thus, in an example embodiment, the reservoir refill system 1000 provides the vehicle 8 with multiple paint sprayers 210 and provides maintenance and service to the hydraulic sprayers 210 by simultaneously providing a larger auxiliary reservoir 1024 which feeds multiple reservoirs 1004 of the multiple paint sprayers 210.

As illustrated in FIG. 25, in one example embodiment, valves 1032*a*, 1032*b* and 1032*c* are positioned along one of the lines 1026*a*, 1026*b*, 1026*c* between the auxiliary reservoir 1024 and each hydraulic sprayer reservoir 1004*a*, 1004*b*, 1004*c*. In this example embodiment, the valves 1032*a*-1032*c* are periodically actuated for a specific amount of time until the hydraulic sprayer reservoirs 1004*a*-1004*c* are filled to a desired level. In an example embodiment, a worker actuates the valves 1032*a*-1032*c* periodically during a day, until the worker observes that the hydraulic sprayer reservoirs 1004*a*-1004*c* are at the desired level or full, such as by observing a reservoir overflow, for example. In one example embodiment, the reservoir refill system 1000 includes a drain to collect any reservoir overflow, such as a holding tank positioned beneath the reservoir on the vehicle, for example. A shelf may be formed above each hydraulic sprayer 210 with the auxiliary reservoir 1024 provided as an inverted bottle of lubricating oil secured on the shelf to discharge lubricating oil when the bottle is squeezed. In this example embodiment, periodically during the day, a worker squeezes the inverted lubricating oil bottle to top off each reservoir 1004 in each hydraulic sprayer 210. Although FIG. 25 illustrates one auxiliary reservoir 1024 used to service all of the reservoirs 1004, a respective auxiliary reservoir can be provided for each hydraulic sprayer reservoir.

An advantage of the reservoir refill system 1000 is that the hydraulic sprayers 210 are not moved during use, because moving the sprayers causes significant loss in throat seal. Thus, the lubricating oil and reservoir usage requirements for the pistons of the paint pumps is significantly lower than in conventional paint pumps, such as 75% lower, for example. A similar refill system can also be provided to refill hydraulic fluid of the sprayers 210.

Figure 26:
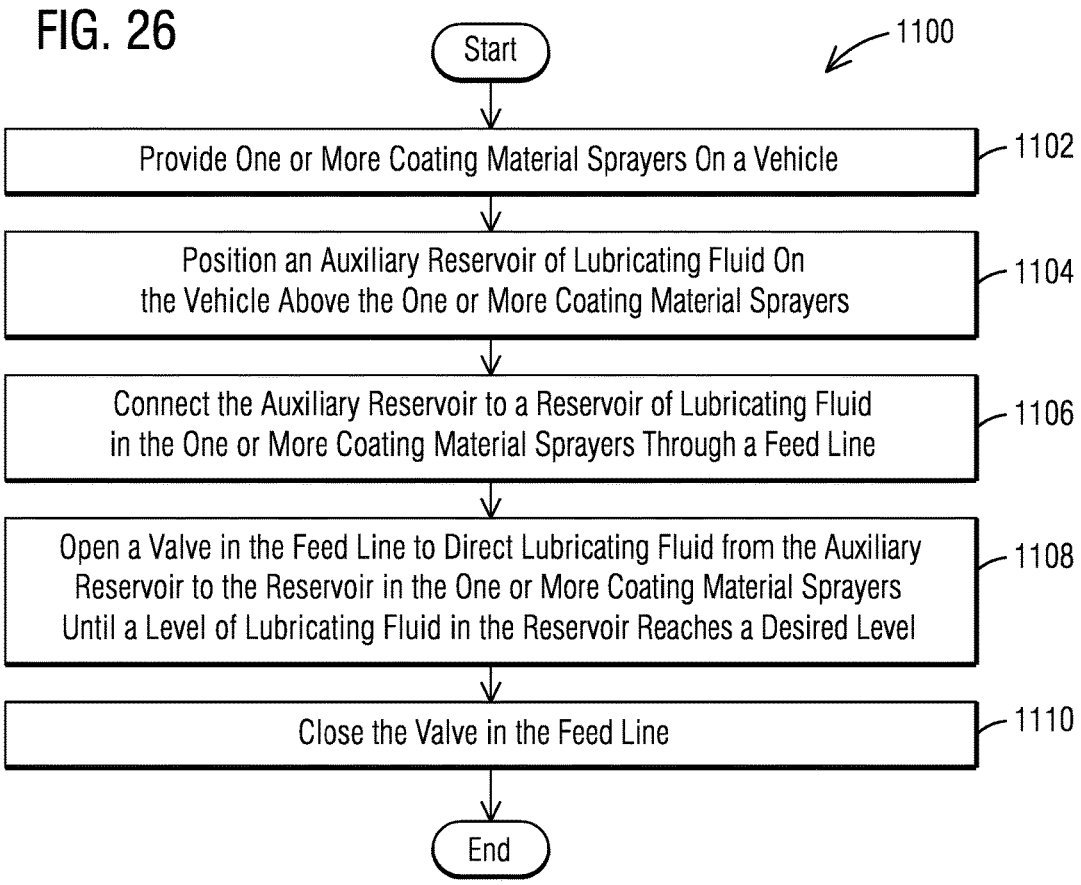
FIG. 26 is a flow diagram that illustrates an example of a method for refilling an oil reservoir in a plurality of paint sprayer engines on a vehicle, according to an embodiment.

FIG. 26 is a flow diagram of a method 1100 for refilling the oil reservoir 1004 in the plurality of paint sprayers 210 on the vehicle 8. In step 1102, one or more paint sprayers 210 are provided on the vehicle 8. In step 1104, the auxiliary reservoir 1024 of lubricating fluid is positioned on the vehicle 8 above the one or more paint sprayers 210.

In step 1106, the auxiliary reservoir 1024 is connected to each reservoir 1004 of lubricating fluid in the one or more paint sprayers 210. In an example embodiment, in step 1106, the auxiliary reservoir 1024 is connected to each reservoir 1004 using respective feed lines 1026 with a respective valve 1032 in each line.

In step 1108, the valves 1032 in each feed line 1026 are opened to direct lubricating fluid from the auxiliary reservoir 1024 to the reservoir 1004 in the plurality of paint sprayers 210 until a level of lubricating fluid in the reservoirs 1004 reaches a desired level. In an example embodiment, step 1108 is performed by manually actuating the valves 1032 until the level of lubricating fluid visibly reaches a desired level. In an example embodiment, the determination of whether the level of lubricating fluid reaches the desired level is based on observing an overflow from the reservoir 1004.

Figure 27:
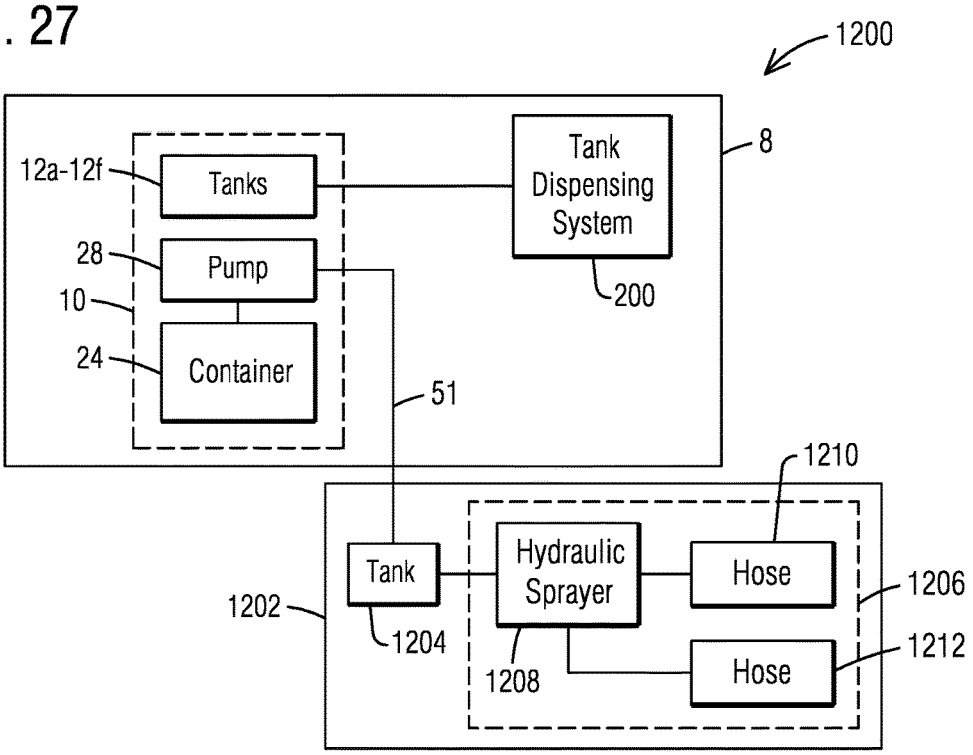
FIG. 27 is a block diagram that illustrates an example of a system for filling tanks on a second vehicle from a pump positioned on a first vehicle, according to an embodiment.

FIG. 27 is a block diagram of a system 1200 for filling a tank 1204 on a second vehicle 1202 from the draw pump 28 positioned on a first vehicle 8. In this example, the system 1200 fills one or more tanks 1204 on the second vehicle 1202, such as a modular trailer, from the draw pump 28 and containers 24 of the system 10 on the vehicle 8. In an example embodiment, during use of the system 1200, instead of connecting the output hoses 51 of the system 10 to the opening in the tops of tanks 12*a*-12*f* on the vehicle 8, the output hoses 51 are connected to openings in a top of the tanks 1204 on the second vehicle 1202. The system 10 is then operated in a similar manner as previously described, except the level of paint is monitored in the tanks 1204 on the second vehicle 1202 and the paint is drawn through the draw pump 28 into the tanks 1204 until the level of paint in the tanks 1204 reaches the desired level. In an example embodiment, the tanks 1204 include the sensor 29 that is used in the system 10 to monitor the level of paint and transmits a signal to deactivate the draw pump 28 if the level of paint reaches the desired level.

As illustrated in FIG. 27, the second vehicle 1202 may include a tank dispensing system 1206 including a hydraulic sprayer 1208 and hose reels 1210, 1212 that operates in a similar manner as the tank dispensing system 200 discussed above. Although the tank dispensing system 1206 on the second vehicle 1202 depicts one hydraulic sprayer 1202 and two hose reels 1210, 1212, the tank dispensing system 1206 is not limited to this arrangement and can include more than one hydraulic sprayer or more than two hose reels. Additionally, although the second vehicle 1202 is depicted as including one tank 1204, the second vehicle can include more than one tank, where each respective tank is connected to the pump 28 with a respective output hose 51, as described in the system 10 on the vehicle 8. In one example embodiment, the second vehicle 1202 remains at the location of the vehicle 8 after the tanks 1204 have been filled and the tank dispensing system 1206 is used to spray paint at a job site of the location of the vehicle 8. In another example embodiment, the second vehicle 1202 is transported to a location other than the location of the vehicle 8 after the tanks 1204 have been filled, such that the tank dispensing system 1206 is used to spray paint at a job site other than the location of the vehicle 8.

Figure 28:
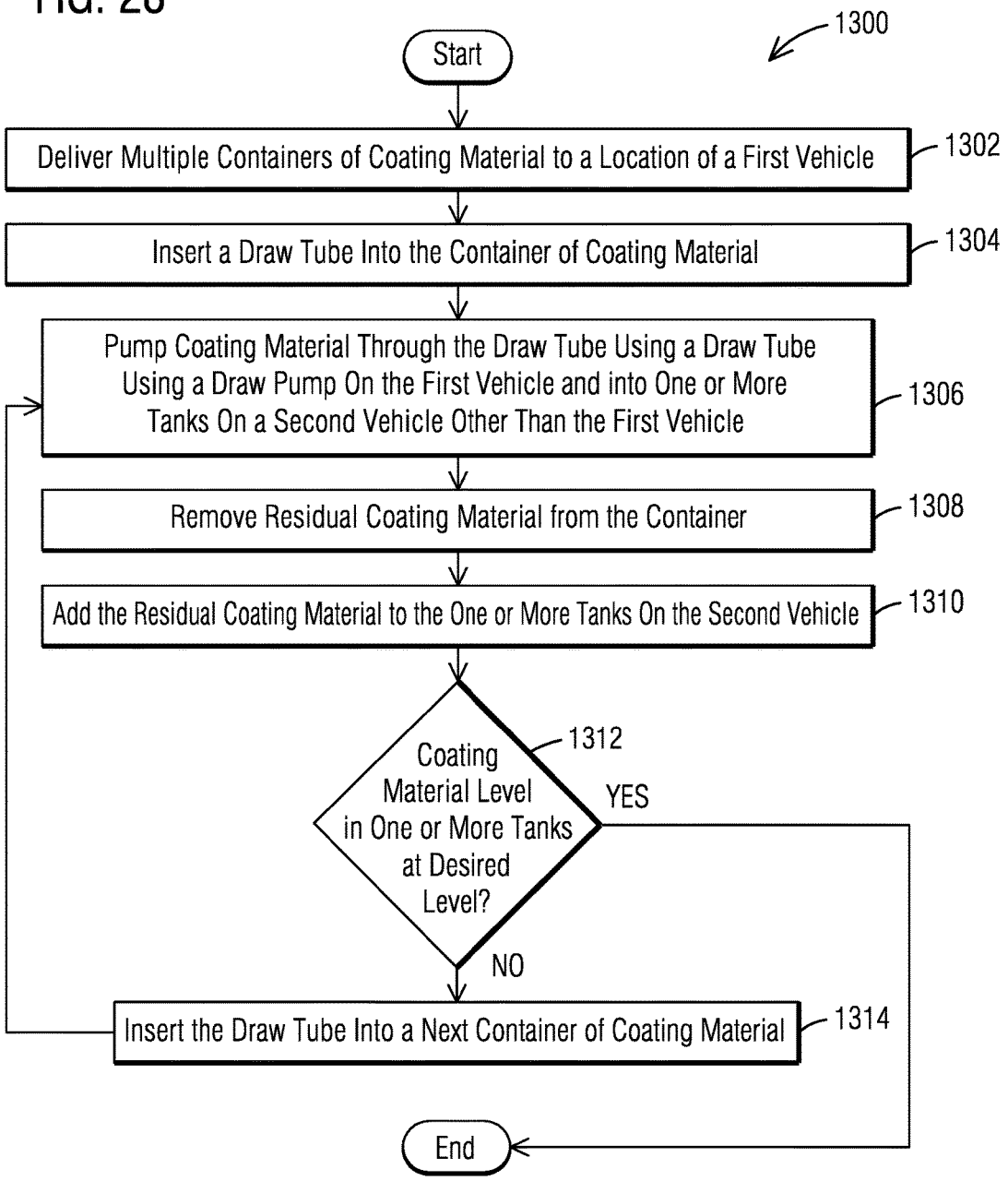
FIG. 28 is a flow diagram that illustrates an example of a method for filling tanks on a second vehicle from a pump positioned on a first vehicle, according to an embodiment.

FIG. 28 is a flow diagram of a method 1300 for filling tanks 1204 on the second vehicle 1202 from the pump 28 positioned on the first vehicle 8. In step 1302, multiple containers 24 of coating material are delivered to a location of the first vehicle 8. In an example embodiment, in step 1302 a quantity of containers 24 are delivered which is sufficient to fill the tanks 12*a*-12*f* on the first vehicle 8 and the tanks 1204 on the second vehicle 1202. In step 1304, the draw tube 26 is inserted into the container 24 of paint, in a similar manner as step 104 of method 100. In step 1306, paint is pumped using the draw pump 28 on the first vehicle 8 and into one or more tanks 1204 on the second vehicle 1202. In steps 1308 and 1310, the residual paint is removed from the container 24 and added to a container 24, after which the residual paint is pumped from the container 24 to the one or more tanks 1204 on the second vehicle 1202 using the draw tube 26 and pump 28, in a similar manner as steps 108 and 110 of method 100. In step 1312, the level of paint in the tank 1204 is monitored and a determination is made whether the level of paint is at a desired level, in a similar manner as step 112 of the method 100. If the determination in step 1312 is positive, then the method 1300 ends. If the determination in step 1312 is negative, the method 1300 proceeds to step 1314, where the draw tube 26 is inserted into a next container 24 of paint and steps 1306, 1308, 1310, 1312 are repeated. In an example embodiment, if the determination in step 1312 is positive, water can be pumped through the draw pump 28 into the tanks 1204 to form the layer 60 of water over the paint in the tanks 1204, in a similar manner as step 116 of the method 100.

Although the flow diagrams of FIGS. 7, 13, 14, 17, 21, 24, 26 and 28 are each depicted as integral steps in a particular order for purposes of illustration, in other embodiments one or more steps, or portions thereof, may be performed in a different order, or overlapping in time, in series or in parallel, or are deleted, or one or more other steps are added, or the method is changed in some combination of ways.

The invention has been described with reference to specific embodiments but it will be evident that various modifications and changes may be made thereto without departing from the broader spirit and scope of the invention. The specification and drawings are, accordingly, to be regarded as illustrative rather than restrictive. Throughout this specification and the claims, unless the context requires otherwise, the word "comprise" and its variations, such as "comprises" and "comprising," will be understood to imply the inclusion of a stated item, element or step or group of items, elements or steps but not the exclusion of any other item, element or step or group of items, elements or steps. Furthermore, the indefinite article "a" or "an" is meant to indicate one or more of the item, element or step modified by the article. As used herein, unless otherwise clear from the context, a value is "about" another value if it is within a factor of two (twice or half) of the other value.

The claimed invention is:

1. A method of providing liquid coating material, including paint, for application to surfaces, comprising:

providing a mobile road vehicle having a bed on which a plurality of tanks are mounted for use on the vehicle, the combined holding capacity of the tanks being at least 300 gallons, the vehicle further including a plurality of hydraulic sprayers mounted for powered operation on the vehicle and a plurality of feed lines connected to extend from the mounted sprayers to dispense coating material at least 200 feet away from the vehicle;

moving the vehicle to a location at which a supply of a first coating material and a supply of a second coating material are present for transfer into the tanks;

transferring coating material from the supply of the first coating material into a first tank in a first subset of the tanks and transferring coating material from the supply of the second coating material into a first tank in a second subset of the tanks with a pumping system mounted on the truck with one or more draw tubes connected to one or more of the supplies of coating material according to the following steps:

(a) with a plurality of fill lines and a manifold having (i) an inlet connected to the pumping system to receive coating material from the draw pump and (ii) multiple outlets for transferring received coating material to each tank via one of the fill lines, each fill line connected between a different one of the outlet and a different one of the tanks, passing first coating material through one or more outlets in a first subset of the manifold outlets to fill at least the first tank in the first subset, and passing second coating material through one or more outlets in a second subset of the manifold outlets to fill at least the first tank in the second subset, where flow of first coating material through each fill line connected between the manifold and at least the first tank in the first subset is controllable with one or more first valves; and flow of second coating material through each fill line connected between the manifold and at least the first tank in the second subset is controllable with one or more second valves; and (b) controlling, with the one or more first valves, flow of first coating material passing through one or more outlets in the first subset of the manifold outlets to selectively fill one or more tanks in the first subset; and (c) controlling, with the one or more second valves, flow of second coating material passing through one or more outlets in the second subset of the manifold outlets to selectively fill one or more tanks in the second subset, where controlling with the valves enables selection of a tank for receipt of the first coating material or the second coating material, said controlling and selection enabling transfer of different coating materials into different tanks via the one or more draw tubes.

2. The method of claim 1 wherein the supply is in the form of one or multiple containers each having a nominal holding capacity of at least five gallons of coating material, the method further including, after transferring a coating material, pumping water through one or more of the draw tubes and into one or more of the tanks to form a layer of water on top of the coating material in one or more of the tank.

3. The method of claim 2 further including, for each in a plurality of the containers from which coating material is transferred, removing residual coating material from the container and transferring the residual coating material into at least one tank.

4. The method of claim 3 wherein the step of transferring the residual coating material includes consolidating the residual coating material acquired from the plurality of containers before transferring the residual coating material into the at least one tank.

5. The method of claim 3 wherein transferring the residual coating material into the at least one tank is performed with the pumping system.

6. The method of claim 3 wherein the supply is in the form of plural containers each having a nominal holding capacity of at least five gallons of coating material and at least three percent of the volume of coating material provided in the totality of containers is residual coating material transferred into at least one tank, which residual coating material is collected from multiple ones of the containers.

7. The method of claim 1 wherein transferring of the coating material from the supply of the first coating material is performed at a minimum rate of five gallons per minute.

8. The method of claim 1 wherein the step of pumping the coating material from the supply transfers at least five gallons of coating material into the manifold in 45 seconds.

9. The method of claim 1 further including, after transferring coating material into one of the tanks, providing a layer of water to cover the coating material.

10. The method of claim 9 wherein the layer of water is of sufficient volume that when most of the coating material is removed from the tank during a spraying operation and the water enters one of the feed lines the water passes through a spray nozzle before associated hydraulic paint sprayer draws air from the tank.

* * * * *